US011268237B2

(12) United States Patent
Fujisawa et al.

(10) Patent No.: US 11,268,237 B2
(45) Date of Patent: Mar. 8, 2022

(54) ELASTIC ARTIFICIAL LEATHER AND PRODUCTION METHOD THEREFOR

(71) Applicant: KURARAY CO., LTD., Kurashiki (JP)

(72) Inventors: Michinori Fujisawa, Okayama (JP); Yukio Maeda, Okayama (JP); Kazumasa Inoue, Okayama (JP); Yasutoshi Nomura, Okayama (JP); Tetsuya Ashida, Okayama (JP); Hisaichi Watanabe, Osaka (JP)

(73) Assignee: KURARAY CO., LTD., Kurashiki (JP)

( * ) Notice: Subject to any disclaimer, the term of this patent is extended or adjusted under 35 U.S.C. 154(b) by 461 days.

(21) Appl. No.: 16/440,117

(22) Filed: Jun. 13, 2019

(65) Prior Publication Data

US 2019/0292723 A1 Sep. 26, 2019

Related U.S. Application Data

(63) Continuation of application No. 14/381,072, filed as application No. PCT/JP2013/054949 on Feb. 26, 2013, now Pat. No. 10,465,338.

(30) Foreign Application Priority Data

Feb. 29, 2012 (JP) ..... 2012-044188
Mar. 15, 2012 (JP) ..... 2012-059384
(Continued)

(51) Int. Cl.
*D06C 21/00* (2006.01)
*D06M 13/00* (2006.01)
*D06N 3/00* (2006.01)

(52) U.S. Cl.
CPC ..... *D06N 3/0027* (2013.01); *D06C 21/00* (2013.01); *D06M 13/00* (2013.01); *D06N 3/0004* (2013.01);
(Continued)

(58) Field of Classification Search
CPC .. D06N 3/0027; D06N 3/0004; D06N 3/0011; D06N 3/0029; D06N 3/0031;
(Continued)

(56) References Cited

U.S. PATENT DOCUMENTS 3,953,271 A 4/1976 Matsuda et al.
6,451,716 B1 9/2002 Sasaki et al.
(Continued)

FOREIGN PATENT DOCUMENTS

CN 1556882 A 12/2004
CN 1590634 A 3/2005
(Continued)

OTHER PUBLICATIONS

International Search Report dated Jun. 11, 2013 in PCT/JP13/054949 Filed Feb. 26, 2013.
(Continued)

*Primary Examiner* — Nathan L Van Sell
(74) *Attorney, Agent, or Firm* — Oblon, McClelland, Maier & Neustadt, L.L.P.

(57) ABSTRACT

Disclosed herein is a method for producing an elastically stretchable artificial leather, which includes the steps of forming microfiberizable fibers into a web, entangling the obtained web to produce an entangled nonwoven fabric, converting the microfiberizable fibers in the nonwoven fabric to microfine fibers thereby producing a substrate for artificial leather, producing an artificial leather from the obtained substrate for artificial leather, bringing the obtained artificial leather into close contact with an elastomer sheet stretched in a machine direction by 5 to 40%, shrinking the artificial leather in the machine direction simultaneously with the elastomer sheet by relaxing elongation of the elastomer sheet to obtain an artificial leather in shrunk state, heat treating the artificial leather in shrunk state, and then
(Continued)

peeling the heat treated artificial leather off from the elastomer sheet.

12 Claims, 9 Drawing Sheets

(30) Foreign Application Priority Data

Mar. 15, 2012 (JP) ..... 2012-059385
Mar. 15, 2012 (JP) ..... 2012-059386

(52) U.S. Cl.
CPC ..... *D06N 3/0011* (2013.01); *D06N 3/0029* (2013.01); *D06N 3/0031* (2013.01); *D06N 3/0036* (2013.01); *D06N 2209/1635* (2013.01); *D06N 2211/28* (2013.01); *Y10T 428/24438* (2015.01)

(58) Field of Classification Search
CPC ..... D06N 3/0036; D06N 2209/1635; D06N 2211/28; D06N 3/00; D06N 3/14; D06C 21/00; D06M 13/00; Y10T 428/24438; B32B 33/00
See application file for complete search history.

(56) References Cited

U.S. PATENT DOCUMENTS

| | | | |
|---|---|---|---|
| 6,517,938 | B1 | 2/2003 | Andoh et al. |
| 7,132,024 | B2 | 11/2006 | Wang et al. |
| 2002/0098756 | A1 | 7/2002 | Sasaki et al. |
| 2003/0022575 | A1 | 1/2003 | Yoneda et al. |
| 2003/0039772 | A1 | 2/2003 | Takeyama et al. |
| 2003/0204942 | A1 | 11/2003 | Wang et al. |
| 2004/0241346 | A1 | 12/2004 | Hanaoka et al. |
| 2004/0242099 | A1 | 12/2004 | Yoshimoto et al. |
| 2005/0084719 | A1 | 4/2005 | Yoshimoto et al. |
| 2007/0231547 | A1 | 10/2007 | Makimura et al. |
| 2008/0163469 | A1 | 7/2008 | Tanaka et al. |
| 2008/0173387 | A1 | 7/2008 | Hanaoka et al. |
| 2010/0105265 | A1 | 4/2010 | Ueno et al. |
| 2010/0159771 | A1 | 6/2010 | Fujisawa et al. |
| 2010/0239817 | A1 | 9/2010 | Makimura et al. |

FOREIGN PATENT DOCUMENTS

| | | | |
|---|---|---|---|
| CN | 1609314 | A | 4/2005 |
| CN | 1957136 | A | 5/2007 |
| CN | 101057025 | A | 10/2007 |
| CN | 101611193 | A | 12/2009 |
| CN | 101691681 | A | 4/2010 |
| EP | 1 273 693 | A2 | 1/2003 |
| EP | 1 437 440 | A1 | 7/2004 |
| EP | 1 978 153 | A1 | 10/2008 |
| EP | 2 184 400 | A1 | 5/2010 |
| GB | 1 236 633 | A | 6/1971 |
| JP | 5 44153 | | 2/1993 |
| JP | 9 31832 | | 2/1997 |
| JP | 2001-214379 | A | 8/2001 |
| JP | 2001-316953 | A | 11/2001 |
| JP | 2002-348784 | A | 12/2002 |
| JP | 2003 89983 | | 3/2003 |
| JP | 2003 89984 | | 3/2003 |
| JP | 2003-253571 | A | 9/2003 |
| JP | 2004 197282 | | 7/2004 |
| JP | 2005 76151 | | 3/2005 |
| JP | 3727181 | | 10/2005 |
| JP | 2008-138313 | A | 6/2008 |
| JP | 4116215 | | 7/2008 |
| JP | 2010 248683 | | 11/2010 |
| JP | 2011-214196 | A | 10/2011 |

OTHER PUBLICATIONS

Combined Chinese Office Action and Search Report dated Jun. 25, 2015 in Patent Application No. 201380011648.2 (with English translation of categories of cited documents).
Yanhao Zhou, et al., "Overview of the recent development of textile rubber strap in Foreign countries" Textile Accessories, No. 5, 1978, pp. 51-53.
Dasheng Zhang, et al., "Developing status and trends of superfine fiber synthetic leather in China and abroad" China Textile Leader, No. 8, 2009, pp. 75-80.
Partial Supplementary European Search Report dated Oct. 28, 2015 in Patent Application No. 13755090.1.
Office Action dated Dec. 1, 2015 in Japanese Patent Application No. 2012-059384.
Extended European Search Report dated Jan. 25, 2016 in Patent Application No. 13755090.1.
Office Action dated Jul. 12, 2017 in European Patent Application No. 13 755 090.1.
Cancellation Reason Notice dated Oct. 12, 2016 in Japanese Patent Application No. 2016-700717.
Office Action dated Apr. 2, 2018 in Chinese Patent Application No. 201610457536.

ELASTIC ARTIFICIAL LEATHER AND PRODUCTION METHOD THEREFOR

CROSS-REFERENCE TO RELATED APPLICATIONS

This application is a Continuation of U.S. Non-Provisional application Ser. No. 14/381,072, which was filed on Aug. 26, 2014. Application Ser. No. 14/381,072 is a National Stage of PCT/JP2013/054949, which was filed on Feb. 26, 2013. This application is based upon and claims the benefit of priority to Japanese Application No. 2012-059386, which was filed on Mar. 15, 2012, and to Japanese Application No. 2012-059385, which was filed on Mar. 15, 2012, and to Japanese Application No. 2012-059384, which was filed on Mar. 15, 2012, and to Japanese Application No. 2012-044188, which was filed on Feb. 29, 2012.

TECHNICAL FIELD

The present invention relates to elastically stretchable artificial leathers which show a moderate stretchability and a feel of resistance to further stretching in the machine direction and are excellent in flexibility, processability, and wearing comfort, and also relates to the production method thereof. The present invention further relates to elastically stretchable artificial leathers excellent in mechanical strength, which show a moderate feel of resistance to further stretching in the machine direction and its production method.

BACKGROUND ART

A leather-like sheet, such as artificial leather, has been used in various applications, such as clothes and materials, because of its flexibility and function not found in natural leather. In view of wearing comfort in clothing use, processability in material use, easy sewing, and appearance of sewn product, much attention has been paid to the elasticity as the most important function.

Therefore, many studies have been carried out on elastically stretchable leather-like sheets. For example, a production method of an artificial leather excellent in the elasticity has been proposed (Patent Document 1), wherein an elastomer sheet which has been stretched in the machine and/or transverse direction by 15% or more is adhesively bonded to an entangled fiber body which is mainly composed of microfine fibers having a single fiber fineness of 0.9 dtex or less and a substrate for artificial leather made of an elastic polymer; the artificial leather is forced to shrink by allowing stretched elastomer sheet to relax; and then the elastomer sheet is removed. However, the proposed production method needs steps of applying an adhesive and removing the adhesive, to reduce the productivity. When the substrate for artificial leather adhesively bonded to the elastomer sheet is forced to shrink, the substrate for artificial leather curls toward the elastomer sheet side, to make the process passing properties poor. Since the substrate for artificial leather is forced to shrink only by the shrinking force of the elastomer sheet, it is difficult to shrink a high-density substrate for artificial leather in a high shrinkage. In addition, the use of an adhesive makes the surface quality of the artificial leather poor.

To eliminate the above drawbacks, a production method free from using an elastomer sheet has been proposed. For example, Patent Document 2 discloses a production method of an artificial leather excellent in stretchability in the transverse direction, in which an artificial leather which is composed of an entangled fiber body mainly including microfine fibers having a single fiber fineness of 1.1 dtex or less and a polyurethane resin is stretched in the machine direction under heating after or simultaneously with the addition of a softening agent, thereby allowing the shrinking in the transverse direction. However, the stretch in the machine direction promotes the unevenness in the mass per unit area and the thickness of the resultant artificial leather. The stretch in the presence of a softening agent results in a suede-finished artificial leather poor in surface uniformity and wear resistance. In addition, the proposed production method is intended to improve the stretchability in the transverse direction of artificial leather. In the proposed production method, since the stretch is made in the machine direction under heating, the obtained artificial leather is less stretchable in the machine direction. Therefore, Patent Document 2 considers nothing about improving the stretchability of artificial leather in the machine direction.

Patent Documents 3 and 4 propose a method of forming wrinkles partly on a fabric or a method of softening a high-density fabric, in which a fabric is forcedly compressed in the machine direction by using a shrinking apparatus which is configured to allow an endless rubber belt to run in contact with a part of the peripheral surface of a heated cylinder roll. However, Patent Documents 3 and 4 describe nothing about artificial leather having an entangled body of microfine fibers and consider nothing about the stretchability of the fabric in the machine direction.

The prior art documents mentioned above do not disclose an easy and efficient method of improving the stretchability and the elasticity of artificial leather in the machine direction. In addition, the prior art documents do not disclose an artificial leather which is improved in the stretchability and the elasticity in the machine direction while the mechanical properties are enhanced by increasing the density.

PRIOR ART

Patent Documents

Patent Document 1: JP 2004-197282A
Patent Document 2: JP 2005-076151A
Patent Document 3: JP 5-44153A
Patent Document 4: JP 9-31832A

DISCLOSURE OF THE INVENTION

Problems to be Solved by the Invention

An object of the invention is to provide a production method of an elastically stretchable artificial leather having a moderate elasticity, a feel of resistance to further stretching, and a good flexibility (particularly flexibility when bending) irrespective of its high density. Another object is to provide an elastically stretchable artificial leather which is improved in mechanical properties by increasing the density and has a moderate feel of resistance to further stretching while having a moderate elasticity in the machine direction. A still another object is to provide an elastically stretchable artificial leather having a moderate feel of resistance to further stretching in the machine direction.

Means for Solving the Problems

The above objects have been achieved by the production method and the first to third elastically stretchable artificial leathers which are described below. The production method of the elastically stretchable artificial leather of the invention comprises:

a step of making microfiberizable fibers into a web;

a step of entangling the obtained web to produce an entangled nonwoven fabric;

a step of converting the microfiberizable fibers in the nonwoven fabric to microfine fibers, thereby producing a substrate for artificial leather;

a step of producing an artificial leather by using the obtained substrate for artificial leather; and a step wherein the obtained artificial leather is brought into close contact with an elastomer sheet which is stretched in a machine direction by 5 to 40%; the artificial leather is allowed to shrink in the machine direction simultaneously with allowing the elastomer sheet to shrink in the machine direction by relaxing elongation of the elastomer sheet; the artificial leather is heat-treated in shrunk state; and then the artificial leather is peeled off from the elastomer sheet.

The production method of the invention may further comprise a step of optionally adding an elastic polymer to the entangled nonwoven fabric or the substrate for artificial leather.

In a preferred embodiment of the production method, an elastomer sheet having a thickness of about 40 to 75 mm is allowed to run in contact with the surface of a roller, thereby allowing the elastomer sheet to stretch and shrink by utilizing the difference between inner and outer circumferences and the elastic recovery. In another preferred embodiment, an artificial leather is heat-treated in shrunk state and then heat-set in shrunk state utilizing the ironing effect of a heated cylinder of drum, roller, etc.

The first elastically stretchable artificial leather comprises an entangled fiber body comprising microfine fibers having an average single fiber fineness of 0.9 dtex or less, which has an apparent density of 0.40 g/cm$^3$ or more and has a micro wave-like structure of microfine fibers which extends along the machine direction on a cross section taken in parallel to both the thickness direction and the machine direction. The number of pitches per millimeter along the machine direction of the wave-like structure is 2.2 or more and the average height of the wave-like structure is 50 to 350 μm.

In a preferred embodiment of the first elastically stretchable artificial leather, the entangled fiber body contains an elastic polymer formed by coagulating an aqueous emulsion of polyurethane. The microfine fiber is preferably a non-elastic fiber, for example, a polyester fiber. The micro wave-like structure is formed preferably by the shrinking in the machine direction and the subsequent heat setting.

The second elastically stretchable artificial leather comprises an entangled fiber body comprising microfine fibers having an average single fiber fineness of 0.9 dtex or less, which has an apparent density of 0.40 g/cm$^3$ or more and an elongation factor of 50 or less when calculated from the following formula (1):

$$\text{Elongation factor} = 5\% \text{ circular modulus in machine direction/thickness} \quad (1).$$

In a preferred embodiment, the second elastically stretchable artificial leather has a micro wave-like structure of microfine fibers which extends along the machine direction on a cross section taken in parallel to both the thickness direction and the machine direction. The ratio of the load at 30% elongation in the machine direction to the load at 5% elongation in the machine direction is preferably 5 or more. The entangled fiber body may contain, for example, an elastic polymer which is formed by coagulating an aqueous emulsion of polyurethane. The microfine fiber is preferably a non-elastic fiber, for example, a polyester fiber. The elastically stretchable artificial leather is produced preferably by the shrinking in the machine direction and the subsequent heat setting.

The third elastically stretchable artificial leather satisfies the following requirements (A) and (B) when determined from a stress-elongation curve in the machine direction which is obtained according to the method of JIS L 1096 (1999) 8.14.1 A for elastic artificial leather:

(A) a stress $F_{5\%}$ at 5% elongation is 0.1 to 10 N/2.5 cm, and (B) the ratio of a stress $F_{20\%}$ at 20% elongation and the stress $F_{5\%}$, $F_{20\%}/F_{5\%}$, is 5 or more.

In a preferred embodiment, the third elastically stretchable artificial leather satisfies any of the following requirements (C) to (F):

(C) the ratio of the slope $S_{20\%}$ of a tangent line to the curve at 20% elongation and the slope $S_{5\%}$ of a tangent line to the curve at 5% elongation, $S_{20\%}/S_{5\%}$, is 1.2 or more;

(D) the maximum slope $S_{0\ to\ 5\%\ max}$ of tangent lines to the curve from zero elongation to 5% elongation is 8 or less;

(E) $F_{20\%}$ is 30 to 200 N/2.5 cm; and (F) the stress $F_{10\%}$ at 10% elongation is 5 to 60 N/2.5 cm.

Effect of the Invention

According to the production method of the invention, an elastically stretchable artificial leather having a moderate elasticity and a feel of resistance to further stretching in the machine direction is obtained.

The first elastically stretchable artificial leather has a high apparent density and a specific wave-like structure, thereby having a moderate elasticity together with a moderate feel of resistance to further stretching due to enhanced mechanical properties in the machine direction.

The second elastically stretchable artificial leather has a high apparent density and a low elongation factor, thereby having a moderate elasticity together with a moderate feel of resistance to further stretching due to enhanced mechanical properties in the machine direction.

The third elastically stretchable artificial leather satisfies the requirements (A) and (B), thereby having a moderate feel of resistance to further stretching in the machine direction. This elastically stretchable artificial leather is suitable for use in interior decorations, seats, shoes, etc. because of its good processability and excellent shape stability after processing. The elastically stretchable artificial leather can keep the round feel of raw material when bending and combinedly has a touch with dense feel.

EMBODIMENTS FOR CARRYING OUT THE INVENTION

Figure 1:
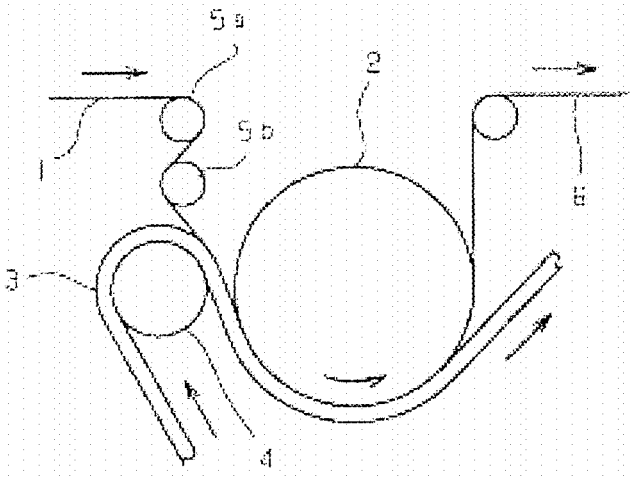
FIG. 1 is a schematic view showing an example of a shrinking apparatus for carrying out the production method of the invention.

The present invention will be described in detail with reference to the following embodiments.

The production method of the elastically stretchable artificial leather comprises:

(1) a step of making microfiberizable fibers into a web;

(2) a step of entangling the obtained web to produce an entangled nonwoven fabric;

(4) a step of converting the microfiberizable fibers in the nonwoven fabric to microfine fibers, thereby producing a substrate for artificial leather;

(5) a step of producing an artificial leather by using the obtained substrate for artificial leather; and (6) a step wherein the obtained artificial leather is brought into close contact with an elastomer sheet stretched in a machine direction by 5 to 40%; the artificial leather is allowed to shrink in the machine direction simultaneously with allowing the elastomer sheet to shrink in the machine direction by relaxing elongation of the elastomer sheet; the artificial leather is heat-treated in shrunk state; and then the artificial leather is peeled off from the elastomer sheet.

By the above production method, a micro buckling structure of microfine fibers is formed along the machine direction of the artificial leather while maintaining the surface flat and smooth, thereby obtaining the artificial leather excellent in elasticity in the machine direction.

The production method may further comprise a step (3) of impregnating an elastic polymer into the entangled nonwoven fabric or the substrate for artificial leather and then coagulating it.

The production of the elastically stretchable artificial leather will be described below with reference to the steps (1) to (6).

Step (1)

In step (1), microfiberizable fibers are made into a web. The microfiberizable fiber is a multi-component composite fiber made from at least two kinds of polymers, for example, a sea-island fiber having a cross section in which an island component polymer is dispersed throughout a sea component polymer which is a different type from the island component polymer. One component of the polymers (removable component) is removed by extraction or decomposition before or after impregnating an elastic polymer into an entangled nonwoven fabric made of microfiberizable fibers, thereby converting the microfiberizable fiber to a bundle of microfine fibers which are made from the remaining polymer (fiber-forming component). In case of the sea-island fiber, the sea component polymer is removed by extraction or decomposition to convert the sea-island fiber to a bundle of microfine fibers made of the remaining island component polymer.

The microfiberizable fiber is suitably selected from sea-island fibers and multi-layered fibers which are produced by mix spinning or composite spinning, although not limited thereto. The present invention will be described below with reference to the sea-island fiber as the microfiberizable fiber. However, it should be noted that microfiberizable fibers other than the sea-island fiber are equally usable in practicing the present invention.

The polymer for forming the microfine fiber (island component of sea-island fiber) is preferably a non-elastic polymer. For example, microfine fibers made from polyamide, polypropylene, or polyethylene are preferred, with polyester being more preferred because the buckling structure (wave-like structure) is retained easily by the heat setting described below. Elastic fibers, for example, polyether ester-based fibers and polyurethane-based fibers such as spandex are not preferred.

Polyester is not particularly limited as long as capable of being made into fibers. Examples thereof include polyethylene terephthalate, polytrimethylene terephthalate, polytetramethylene terephthalate, polycyclohexylenedimethylene terephthalate, polyethylene-2,6-naphthalene dicarboxylate, and polyethylene-1,2-bis(2-chlorophenoxy)ethane-4,4'-dicarboxylate, with polyethylene terephthalate which is most generally used and modified polyester which is mainly constituted of ethylene terephthalate units (for example, isophthalic acid-modified polyethylene terephthalate) being suitable.

Examples of polyamide include polymers having amide bonds, such as nylon 6, nylon 66, nylon 610, and nylon 12.

Inorganic particles such as titanium oxide may be added to the island component polymer to enhance opacity and a compound such as lubricant, pigment, heat stabilizer, ultraviolet absorber, conducting agent, heat storage material, and antibacterial agent may be added to the island component polymer according to intended uses of products.

When converting the sea-island fiber to a bundle of microfine fibers, the sea component polymer is removed by extraction with a solvent or decomposition with a decomposer. Therefore, the sea component polymer is needed to be well soluble to a solvent and easily decomposable by a decomposer, as compared with the island component polymer. To stably spin the sea-island fiber, the sea component polymer is preferably less compatible with the island component polymer and preferably has a melt viscosity and/or a surface tension each being lower than that of the island component polymer under the spinning conditions. The sea component polymer is not particularly limited as long as meeting the requirements mentioned above, and preferably selected from, for example, polyethylene, polypropylene, polystyrene, ethylene-propylene copolymer, ethylene-vinyl acetate copolymer, styrene-ethylene copolymer, styrene-acryl copolymer, and polyvinyl alcohol resin. Since the artificial leather is produced without using an organic solvent, the sea component polymer is preferably a water-soluble thermoplastic polyvinyl alcohol (PVA) or a water-soluble thermoplastic modified polyvinyl alcohol (modified PVA), for example, ethylene-modified PVA.

The average fineness of sea-island fiber is preferably 1.0 to 6.0 dtex. In the cross section of sea-island fiber, the ratio of the sea component polymer and the island component polymer is preferably 5/95 to 70/30 by mass and the number of island is preferably 5 or more.

The spinning method of the microfiberizable fiber is not particularly limited and the microfiberizable fiber may be produced by a method conventionally used in the production of artificial leathers. The microfiberizable fiber may be either staple fiber or filament. Staple fibers are preferred for the production of a nonwoven fabric having high-quality surface. In contrast, filaments are preferred in view of its simple production process and good physical properties, such as toughness. An artificial leather having the elasticity in the machine direction is generally difficult to produce from non-elastic filaments; however, according to the production method of the invention, an artificial leather having the elasticity in the machine direction can be produced even when non-elastic fibers are used. In the present invention, filaments are preferable to staple fibers, because the elongation factor can be made good by forming the wave-like structure as mentioned below.

Microfiberizable staple fibers are made into a web by a dry method, such as carding, or a wet method, such as paper-making method, with a dry method being preferred because an artificial leather having a high-quality surface is obtained.

Microfiberizable filaments are made into a web by a spun-bonding method and may be partially broken unexpectedly during the subsequent processes for producing the artificial leather as long as continuous filaments are collected to form the web.

In the present invention, filament means a fiber which is longer than staple fiber having a length generally about 3 to 80 mm and is not intentionally cut unlike staple fiber. For example, the length of filament before converting to microfine fiber is preferably 100 mm or longer and may be several meters, hundreds of meter, several kilo-meters or longer as long as capable of technically producing or being not physically broken. A web made from microfiberizable filaments may be heat-pressed to fuse the fibers on its surface temporally, because the shape of web is stabilized to improve the handling ability in the subsequent processes.

The mass per unit area of the web obtained in step (1) is preferably 10 to 100 g/m$^2$.

Step (2)

In step (2), the web obtained in step (1) is entangled by needle punching or water jetting to produce an entangled nonwoven fabric. For example, the web is, after laid into layers by a crosslapper if necessary, needle-punched from both surfaces simultaneously or alternately so as to allow at least one barb to penetrate through the web. The punching density is preferably 200 to 5000 punch/cm$^2$. Within this range, the microfiberizable fibers are sufficiently entangled and little damaged by needles. By the entangling treatment, the microfiberizable fibers are three-dimensionally entangled to obtain an entangled nonwoven fabric in which the microfiberizable fibers are extremely closely compacted. A silicone oil agent or a mineral oil agent, for example, an oil agent for preventing needle break, an antistatic oil agent and an oil agent for promoting entanglement, may be added to the web at any stage from the production of web to the entangling treatment. The entangled nonwoven fabric may be immersed in a hot water at 70 to 100° C., if necessary, to densify the entangled structure by shrinking. In addition, the entangled nonwoven fabric may be hot-pressed to compacting the microfiberizable fibers for stabilizing the shape. The mass per unit area of the entangled nonwoven fabric is preferably 100 to 2000 g/m$^2$.

Step (3)

In step (3), an aqueous dispersion or an organic solvent solution of an elastic polymer is optionally impregnated to the entangled nonwoven fabric obtained in step (2) and then coagulated. If the microfiberizable fibers are filaments, the use of the elastic polymer may be omitted.

Examples of the elastic polymer include polyurethane elastomer, polyurea elastomer, polyurethane polyurea elastomer, polyacrylic acid resin, acrylonitrile-butadiene elastomer, and styrene-butadiene elastomer, with a polyurethane-based elastomer, such as polyurethane elastomer, polyurea elastomer, and polyurethane polyurea elastomer, being preferred, and a polyurethane-based elastomer produced by using a polymer diol having a number average molecular weight of 500 to 3500 which is selected from, for example, polyester diol, polyether diol, polyester polyether diol, polylactone diol, and polycarbonate diol, being more preferred. In view of durability of products, a polyurethane produced by using a polymer diol which contains 30% by weight or more of polycarbonate diol is preferred. The durability is enhanced when the content of polycarbonate diol is 30% by weight or more.

The number average molecular weight referred to herein is measured by gel permeation chromatography (GPC) using polymethyl methacrylate as the standard.

The polycarbonate diol has a polymer chain which is composed of diol units linked by carbonate bonds and terminated with hydroxyl groups. The type of the diol unit is not particularly limited and determined by the starting glycol to be used. Examples of the glycol include 1,6-hexanediol, 1,5-pentanediol, neopentyl glycol, and 3-methyl-1,5-pentanediol. A polycarbonate diol copolymerized two or more kinds of glycols selected from the above is preferred, because an artificial leather excellent, in particular, in flexibility and appearance is obtained. If an artificial leather excellent particularly in flexibility is desired, a polymer diol introduced with a chemical bonding other than carbonate bonding, such as ester bonding and ether bonding, in an amount not adversely affecting the durability is preferably used.

Such chemical bonding can be introduced by a method, in which a polycarbonate diol and another polymer diol are separately produced by homopolymerization and then these polymers are mixed in an appropriate ratio when producing polyurethane.

The polyurethane-based elastomer is produced by the reaction of a polymer diol, an organic polyisocyanate, and a chain extender in a desired ratio. The reaction conditions are not particularly limited and the polyurethane-based elastomer may be produced by a conventionally known method.

Examples of the polymer diol include polyether polyols and their copolymers, such as polyethylene glycol, polypropylene glycol, polytetramethylene glycol, and poly(methyltetramethylene glycol); polyester polyols and their copolymers, such as polybutylene adipate diol, polybutylene sebacate diol, polyhexamethylene adipate diol, poly(3-methyl-1,5-pentylene adipate) diol, poly(3-methyl-1,5-pentylene sebacate) diol, and polycaprolactone diol; polycarbonate polyols and their copolymers, such as polyhexamethylene carbonate diol, poly(3-methyl-1,5-pentylene carbonate) diol, polypentamethylene carbonate diol, and polytetramethylene carbonate diol; and polyester carbonate polyols. A polyfunctional alcohol, such as a trifunctional alcohol and a tetrafunctional alcohol, or a short-chain alcohol, such as ethylene glycol, may be combinedly used, if necessary. These polymer diols may be used alone or in combination of two or more. In view of obtaining an artificial leather well-balanced between flexibility and dense feel, an amorphous polycarbonate polyol, an alicyclic polycarbonate polyol, a straight-chain polycarbonate polyol copolymer, and a polyether polyol are preferably used.

Examples of the organic diisocyanate include a non-yellowing diisocyanate, for example, an aliphatic or alicyclic diisocyanate, such as hexamethylene diisocyanate, isophorone diisocyanate, norbornene diisocyanate, and 4,4'-dicyclohexylmethane diisocyanate; and an aromatic diisocyanate, such as 2,4-tolylene diisocyanate, 2,6-tolylene diisocyanate, 4,4'-diphenylmethane diisocyanate, and xylylene diisocyanate polyurethane. A polyfunctional diisocyanate, such as a trifunctional diisocyanate and a tetrafunctional diisocyanate, may be combinedly used. These diisocyanates may be used alone or in combination of two or more.

Of the above diisocyanates, preferred are 4,4'-dicyclohexylmethane diisocyanate, isophorone diisocyanate, 2,4-tolylene diisocyanate, 2,6-tolylene diisocyanate, 4,4'-diphenylmethane diisocyanate, and xylylene diisocyanate in view of excellent mechanical properties.

Examples of the chain extender include diamines, such as hydrazine, ethylenediamine, propylenediamine, hexamethylenediamine, nonamethylenediamine, xylylenediamine, isophoronediamine, piperazine and its derivatives, dihydrazide of adipic acid, and dihydrazide of isophthalic acid; triamines, such as diethylenetriamine; tetramines, such as triethylenetetramine; diols, such as ethylene glycol, propylene glycol, 1,4-butanediol, 1,6-hexanediol, 1,4-bis(β-hydroxyethoxy)benzene, and 1,4-cyclohexanediol; triols, such as trimethylolpropane; pentaols, such as pentaerythritol; and amino alcohols, such as aminoethyl alcohol and aminopropyl alcohol. These chain extender may be used alone or in combination of two or more.

The combined use of two or more selected from hydrazine, piperazine, ethylenediamine, hexamethylenediamine, isophoronediamine and its derivatives, and triamine, such as ethylenetriamine, is preferred in view of mechanical properties. During the chain extending reaction, a monoamine, such as ethylamine, propylamine and butylamine; a carboxyl group-containing monoamine compound, such as 4-aminobutanoic acid and 6-aminohexanoic acid; or a monool, such as methanol, ethanol, propanol and butanol, may be combinedly used with the chain extender.

The elastic polymer is impregnated into the entangled nonwoven fabric in the form of an aqueous solution, an aqueous dispersion, or an organic solvent solution, for example, a solution in an organic solvent, such as dimethylformamide, methyl ethyl ketone, acetone, and toluene. The impregnation method is not particularly limited, and a method of distributing uniformly inside the entangled nonwoven fabric by dipping and a method applying on the top and back surfaces can be employed. The impregnated aqueous solution, aqueous dispersion, or organic solvent solution of the elastic polymer is coagulated according to the conditions and methods (for example, wet method and dry method) conventionally employed in the production of artificial leather.

The concentration of the elastic polymer in an aqueous solution, an aqueous dispersion (for example, an aqueous emulsion), or an organic solvent solution is preferably 5 to 50% by weight.

In a preferred embodiment, an aqueous dispersion of the elastic polymer is impregnated into the entangled nonwoven fabric, thereby making the coagulated product of the aqueous emulsion of the elastic polymer to be included in the entangled fiber body. By including the coagulated product of the aqueous emulsion of the elastic polymer in the entangled fiber body, the wave-like structure may be easily formed and retained by the mechanical shrinking treatment and the heat set treatment which are mentioned below. When polyamide microfine fibers and so on which are difficult to heat-set are used, the impregnation of the elastic polymer into the entangled nonwoven fabric by using its organic solvent solution is not preferred, because the wave-like structure is difficult to form and retain by the mechanical shrinking treatment and the heat set treatment.

The amount of the elastic polymer to be added depends on the fiber length (staple or filament) and the manner of addition (aqueous solution, aqueous dispersion, or organic solvent solution) and is preferably 5 to 70% by weight of the weight of microfine fibers on solid basis in view of flexibility, surface touch, and uniform dyeability of products. In particular, the amount is preferably 10 to 70% by weight of the weight of microfine fibers on solid basis, when using staple fibers and impregnating an organic solvent solution of the elastic polymer. If being less than 10% by weight, the abrasion resistance is easily reduced, while the touch unfavorably becomes hard if exceeding 70% by weight.

An additive, such as colorant, antioxidant, antistatic agent, dispersant, softener, and coagulation modifier may be blended in the elastic polymer if necessary.

Step (4)

In step (4) the microfiberizable fibers in the nonwoven fabric obtained in step (2) which does not contain the elastic polymer or in the nonwoven fabric obtained in step (3) which is impregnated with the elastic polymer are converted to bundles of microfine fibers, to produce a substrate for artificial leather which comprises an entangled body of microfine fiber bundles or comprises the entangled body and the elastic polymer impregnated thereinto.

The microfiberizable fibers are converted to bundles of microfine fibers by removing the sea component polymer. The sea component polymer is removed preferably by treating the nonwoven fabric containing the elastic polymer with a solvent which does not dissolve the island component polymer, but dissolves the sea component polymer or a decomposer which does not decompose the island component polymer, but decompose the sea component polymer. When the island component polymer is a polyamide-based resin or a polyester-based resin, an organic solvent, such as toluene, trichloroethylene, and tetrachloroethylene, are used if the sea component polymer is polyethylene; hot water is used if the sea component polymer is a water-soluble thermoplastic PVA or modified PVA; or an alkaline decomposer, such as an aqueous solution of sodium hydroxide, is used if the sea component polymer is an easily alkali-decomposable modified polyester. The removing method and conditions are not particularly limited, and the sea component polymer may be removed by a method and conditions conventionally employed in the artificial leather art. If a method with less environmental load is desired, a microfiberizable fiber containing a water-soluble thermoplastic PVA or modified PVA as the sea component polymer is preferably used, which is treated in hot water at 85 to 100° C. for 100 to 600 s without using an organic solvent until 95% by mass or more (inclusive of 100%) of the sea component polymer is removed by extraction, thereby converting the microfiberizable fibers to bundles of microfine fibers each formed from the island component polymer.

The average single fiber fineness of the microfine fibers which form the entangled body of the substrate for artificial leather is preferably 0.9 dtex or less, more preferably 0.0001 to 0.9 dtex, still more preferably 0.0001 to 0.5 dtex, and particularly preferably 0.005 to 0.3 dtex. If being less than 0.0001 dtex, the toughness of the substrate for artificial leather may be reduced. If exceeding 0.9 dtex, the touch of the substrate for artificial leather is made hard and the fibers are entangled insufficiently, to cause problems of impairing the surface quality of the substrate for artificial leather or reducing the abrasion resistance in some cases.

The substrate for artificial leather may contain fibers having a single fiber fineness of less than 0.0001 dtex or fibers having a single fiber fineness of exceeding 0.9 dtex in a limited amount not adversely affect the effects of the invention. The content of the fibers having a single fiber fineness of less than 0.0001 dtex and the fibers having single fiber fineness of exceeding 0.9 dtex is preferably 30% or less (number basis) of the total fibers constituting the substrate for artificial leather, more preferably 10% or less (number basis), and still more preferably the substrate for artificial leather is completely free from these fibers.

The fineness of microfine fiber bundle is preferably 1.0 to 4.0 dtex, and the number of microfine fibers in a single bundle is preferably 9 to 500. Within the above range, the substrate for artificial leather and the suede-finished artificial leather produced from it have good uniform appearance, and well-balance in dyeability and abrasion resistance. Like the microfiberizable fiber, the microfine fiber may be either staple or filament.

The mass per unit area of the substrate for artificial leather is preferably 150 to 1500 g/m$^2$. If being 150 g/m$^2$ or more, a good rebound resilience is obtained. If being 1500 g/m$^2$ or less, the processability for various uses is good. The apparent density of the substrate for artificial leather is preferably 0.25 to 0.80 g/cm$^3$. If being 0.25 g/cm$^3$ or more, the abrasion resistance is good. If being 0.80 g/cm$^3$ or less, the processability for various uses is good. The thickness of the substrate for artificial leather is selected according to the use of the artificial leather, and generally selected from 0.3 to 3.0 mm.

Sep (3) may be omitted or may be carried out after step (4) to impregnate the elastic polymer to the substrate for artificial leather obtained by converting the microfiberizable fibers to microfine fibers.

In addition to the additives mentioned above, the substrate for artificial leather may contain a functional chemical, such as another type of dye, softener, touch modifier, anti-pilling agent, antibacterial agent, deodorant, water repellant, light resisting agent, and weathering agent, in an amount not adversely affecting the effect of the invention.

Step (5)

In step (5), the substrate for artificial leather obtained by the above method is provided with a grain layer on at least one surface or napped to raise naps on at least one surface so that a grain-finished artificial leather, a semi grain-finished artificial leather, a raised artificial leather, or a nubuck-finished artificial leather is obtained. The method of forming the grain layer on at least one surface of the substrate for artificial leather and the method of forming the raised nap surface on at least one surface of the substrate for artificial leather are not particularly limited, and the methods conventionally used in the production of artificial leather can be employed. For example, the grain layer is formed by a dry forming method in which a layer for forming the grain layer and an adhesive layer which are formed on a release paper are adhered to at least one surface of the substrate for artificial leather via the adhesive layer, or a method in which a dispersion or a solution of an elastic polymer for forming the grain layer is applied to at least one surface of the substrate for artificial leather, which is then made into the grain layer by a dry coagulation, etc. The raised nap surface may be formed by napping at least one surface of the substrate for artificial leather with a card clothing or a sandpaper and then ordering the raised naps.

The artificial leather may be dyed with an acid dye, etc. by using a jet dyeing machine, etc.

The mass per unit area of the artificial leather thus obtained is preferably 130 to 1600 g/m$^2$ and more preferably 150 to 1400 g/m$^2$. The apparent density is preferably 0.25 to 0.80 g/cm$^3$ and more preferably 0.30 to 0.70 g/cm$^3$. The thickness is preferably 0.5 to 2.0 mm.

Step (6)

In step (6), the artificial leather obtained in step (5) is mechanically shrunk in the machine direction (MD of production line) and then heat-treated in shrunk state for heat setting, to obtain an elastically stretchable artificial leather having a moderate stretchability and a feel of resistance to further stretching in the machine direction, and an excellent flexibility.

The mechanical shrinking treatment for obtaining the elastically stretchable artificial leather is carried out, for example, by a method in which a thick elastomer sheet (for example, rubber sheet and felt) with a thickness of several centimeters or more is stretched in the machine direction; an artificial leather is brought into close contact with the stretched surface; and the stretched surface is allowed to elastically recover from the stretched state to the state before stretching, thereby shrinking the artificial leather in the machine direction. An example of an apparatus for shrinking the artificial leather in this manner is schematically shown in FIG. 1. A belt 3 made of a thick elastomer sheet moves in contact with the surface of a pressure roller 4 (the surface is metal), during which the outer surface of the belt 3 is stretched in the machine direction by the difference between inner and outer circumferences. An artificial leather 1 being fed by turn rollers 5*a* and 5*b* is brought into close contact with the stretched outer surface of the belt 3. The belt 3 and the artificial leather 1 in contact with the belt pass through the gap between the pressure roller 4 and the drum 2 having a metal surface and then run in contact with the surface of the drum 2.

After passing through the gap, the belt 3 runs along the drum 2 while holding the artificial leather 1 therebetween, and therefore, the opposite surface of the belt 3 is in turn stretched, this allowing the surface of the belt 3 in contact with the artificial leather 1 to elastically recover from the stretched state to the state before stretching, and shrink in the running direction (machine direction) while being pushed from behind. As the belt 3 elastically recovers from the stretched state, the artificial leather 1 is shrunk in the running direction (machine direction) while being pushed from behind, and thereafter, the artificial leather 6 thus shrunk is taken off.

To stretch the outer surface of the elastomer sheet at the elongation within the range mentioned below by utilizing the difference between inner and outer circumferences, the outer diameter of the pressure roller 4 is preferably 10 to 50 cm. To allow the elastomer sheet to elastically recover the state before stretching by relaxing the elongation of its outer surface, thereby shrinking the elastomer sheet in the machine direction (running direction) while shrinking the artificial leather in the machine direction (running direction) at the shrinkage within the range mentioned below, the outer diameter of the drum 2 is preferably larger than that of the pressure roller 4 and 20 to 80 cm. The diameter of the drum 2 is preferably as large as possible in view of an efficient heat setting by prolonging the heat treatment time. However, the diameter is preferably smaller in view of shrinking the elastomer belt by the difference between inner and outer circumferences at the shrinkage within the range specified in the present invention. The outer diameters of the drum 2 and the roller 4 are determined by taking these requirements, and are preferably determined with giving priority to the heat treatment time.

Generally the pressure roller 4 is not directly heated, and instead, the raw material (artificial leather) before shrinking process is pre-heated. The surface temperature of the roller 4 after reaching steady operation is preferably about 40 to 90° C.

The surface of the drum 2 is preferably heated to 70 to 150° C. The drum 2 works as a shrink-heating zone for shrinking the artificial leather under heating and also works for heat-setting the shrunk artificial leather by heat-treating. The belt 3 is preferably a thick belt of rubber or felt generally having a thickness of 20 mm or more. The shrinking effect of the artificial leather 1 can be enhanced when the feeding speed of the artificial leather 1 by the turn rollers 5*a* and 5*b* shown in FIG. 1 is higher than that by the belt 3, because the artificial leather 1 is folded in the machine direction on the surface of the belt 3, and the folded artificial leather 1 shrinks as the surface of the thick belt 3 elastically recovers from the stretched state.

Figure 2:
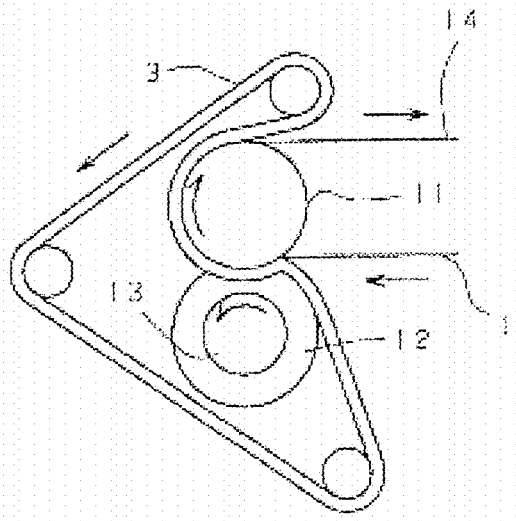
FIG. 2 is a schematic view showing another example of a shrinking apparatus for carrying out the production method of the invention.

In another method for the mechanical shrinking treatment, the artificial leather is shrunk in the machine direction (running direction) by the elastic recovery of the stretched elastomer sheet which is deformed by nipping between pressure rollers. FIG. 2 is a schematic view showing an example of the apparatus for shrinking the artificial leather in this method. An elastomer belt 3 runs circularly along the surfaces of a metal roller 11 and a rubber roller 13 having a thick rubber portion 12. In the nip portion between the metal roller 11 and the rubber roller 13, the thick rubber portion 12 is stretched because it is deformed by nip pressure toward the center of the rubber roller 13, while the belt 3 is compressed by nip pressure in the thickness direction. An artificial leather 1 is fed onto the outer surface of the belt 3 between the metal roller 11 and the rubber roller 13. The belt 3 is stretched lengthwise as it is compressed in the thickness direction. After passing through the nip, the stretched state is released to allow the belt 3 to shrink (elastic recovery), this simultaneously allowing the artificial leather 1 on the outer surface of the belt 3 to shrink in the machine direction. Assuming that the rubber belt 3 is not deformed in the width direction, the rubber belt 3 is deformed to almost twice the original length when the thickness is compressed to half. Thereafter, the shrunk artificial leather 1 runs along the surface of the heated metal roller 11 while being held between the belt 3 and metal roller 11 and then taken off.

The metal roller 11 is preferably heated to a surface temperature of 70 to 150° C. The heated metal roller 11 works as the shrink-heating zone as mentioned above and also works as a member for heat-setting the shrunk artificial leather 1 by heat-treating.

Generally the rubber roller 13 is not directly heated, and instead, the raw material (artificial leather) before shrinking process is pre-heated. The surface temperature of the rubber roller 13 after reaching steady operation is preferably about 40 to 90° C.

The method of stretching the elastomer sheet in the machine direction is not limited to those described above in which the elastomer sheet is stretched in the machine direction by utilizing the difference between inner and outer circumferences or by compressing the elastomer sheet in the thickness direction, and the elastomer sheet may be stretched by other methods.

The production method of the artificial leather of the invention which comprises the mechanical shrinking treatment mentioned above is characterized by bringing the artificial leather into close contact with the surface of the elastomer sheet without using an adhesion means such as adhesive, while stretching the surface of the elastomer sheet in the machine direction, and then, shrinking the artificial leather in the running direction (machine direction) while pushing from behind by relaxing the stretched state to cause the surface of the elastomer sheet to elastically recover the state before stretching. The elongation ((deformation by stretching/length before stretching)×100) of the surface of the elastomer sheet with which the artificial leather is brought into contact is 5 to 40%, preferably 7 to 25%, and more preferably 10 to 20%. If being 5% or more, an artificial leather stretchable in the machine direction is obtained by the shrinking treatment of step (6) even when the artificial leather before treatment is hardly stretchable in the machine direction. For example, an artificial leather made of staple fibers having a mass per unit area of 250 g/m$^2$ or less is difficult to stretch in the machine direction, because it is already stretched by the tension applied during its production. However, according to the production method of the invention, an artificial leather easily stretchable in the machine direction can be obtained even when the artificial leather to be processed is made of staple fibers. A spun-bond web generally provides an artificial leather difficult to stretch in the machine direction because filaments are oriented in the machine direction. According to the production method of the invention, however, an artificial leather stretchable in the machine direction is obtained from a spun-bond web.

The shrinking treatment described above is carried out preferably at 70 to 150° C., more preferably at 90 to 130° C. The artificial leather is allowed to shrink in the machine direction in a shrinkage of preferably 2 to 20% and more preferably 4 to 15%.

$$\text{Shrinkage}=[(\text{length before shrinking})-(\text{length after shrinking})]/\text{length before shrinking}\times 100$$

In the above methods, the apparent coefficient of dynamic friction between the elastomer sheet 3 and the artificial leather 1 is preferably 0.8 to 1.7 and more preferably 1.1 to 1.6. The coefficient of dynamic friction between the cylinder (roller 2 or roller 11) and the artificial leather 1 is preferably 0.5 or less and more preferably 0.4 or less. If the coefficient of dynamic frictions are within the above ranges, the shrinking force of the elastomer sheet is transmitted uniformly to the artificial leather, allowing the artificial leather to shrink in the machine direction effectively.

The coefficient of dynamic friction is determined by measuring the tensile load resistance when moving an artificial leather slidingly on an elastomer sheet or a cylinder under a load of 1.5 kgf and dividing the measured value by 1.5.

The elastomer sheet used in the invention is not particularly limited as long as it is a sheet having the elastic properties mentioned above. The elastomer sheet is preferably a natural rubber sheet or a synthetic rubber sheet, because a natural or synthetic rubber elastomer sheet exhibits a high elastic recovery, and the artificial leather which is in contact with the elastomer sheet is sufficiently shrunk together with the shrinking elastomer sheet by overcoming the resistance of the artificial leather. The tension of the elastomer sheet is preferably controlled low and the hardness of the elastomer sheet is preferably low, because the structural change of the artificial leather surface due to heating and pressure is prevented during the shrinking treatment.

The thickness of the elastomer sheet is preferably 20 to 100 mm and more preferably 40 to 75 mm. Within the above range, the elastomer sheet is stretched and shrunk effectively in the machine direction by utilizing the difference between inner and outer circumferences.

Examples of the natural rubber include a rubber composed mainly of cis-1,4-polyisoprene which is collected from bark of Hevea, etc.

Examples of the synthetic rubber include styrene-butadiene rubber, butadiene rubber, isoprene rubber, butyl rubber, ethylene-propylene rubber, chloroprene rubber, nitrile rubber, silicone rubber, acrylic rubber, epichlorohydrin rubber, fluorine rubber, urethane rubber, ethylene-vinyl acetate rubber, and chlorinated polyethylene rubber.

Since the artificial leather is heat-treated in shrunk state for heat setting before peeled off from the elastomer sheet, an elastomer sheet excellent in the heat resistance is preferred, and a heat-resistant rubber, such as silicone rubber, fluorine rubber, and ethylene-propylene rubber, is preferably used.

In the production method of the invention, after shrinking the artificial leather in the machine direction, the artificial leather is heat-treated and heat-set in shrunk state, for example, before peeling off the artificial leather from the elastomer sheet. By these treatments, the elasticity of the artificial leather is enhanced. Instead of heat-treating before peeling off the artificial leather from the elastomer sheet, the heat treatment may be carried out after peeling off the artificial leather from the elastomer sheet or may be carried out twice before and after peeling off.

The heat treatment temperature (for example, the surface temperature of the metal roller 11 or the drum 2) is selected from the range mentioned above, i.e., preferably 70 to 150° C. and more preferably 100 to 150° C. while taking the heat history of fibers in the artificial leather during the production processes into account.

For example, when the artificial leather which has been moist heat-treated at 120° C. by a jet dyeing machine is heat-treated, the heat treatment temperature is preferably 120° C. or higher for the moist heat treatment and preferably 140° C. or higher for the dry heat treatment.

The moist heat treatment referred to herein is a heat treatment accompanied with humidification and the dry heat treatment referred to herein is a heat treatment without humidification.

The heat treatment (heat set) time depends on the type of polymer which constitutes the fibers in the artificial leather and the heat treatment temperature, and is generally selected from 0.1 to 5 min. For example, the heat treatment time is preferably 1 to 3 min for polyethylene terephthalate fibers in view of heat setting and processing stability. If the heat setting is insufficient by a single heat treatment, the heat treatment (heat set) is preferably repeated after peeling off the artificial leather from the elastomer sheet.

The heat treatment can be carried out by a known method, for example, by blowing hot air to the artificial leather, heating the artificial leather by an infrared heater, or heat-treating the artificial leather between a heated cylinder and an elastomer sheet or a nonwoven fabric sheet. A method of utilizing the iron effect of the heated cylinder in which the artificial leather is heat-treated between the heated cylinder (drum 2 or metal roller 11) and the sheet, for example, as shown in FIGS. 1 and 2 is preferably used, because the treatment can be carried out at low tension. The artificial leather thus heat-treated is then taken off generally at a speed of 2 to 15 m/min.

To shrink the artificial leather in the machine direction more effectively, a pre-heating treatment, a humidifying treatment, or both is preferably carried out to soften the artificial leather before bringing the artificial leather into close contact with the elastomer sheet. The pre-heating treatment is carried out by a known heating method, for example, by heating the artificial leather under humidified condition while spraying steam or water, blowing hot air to the artificial leather, or heating the artificial leather by an infrared heater. The humidifying treatment is not particularly limited as long as the artificial leather is humidified and carried out, for example, by spraying steam or water to the artificial leather.

The optimum conditions of the pre-heating treatment depend on the artificial leather to be treated, and the pre-heating temperature is preferably 40 to 100° C. The amount of water to be added is preferably 1 to 5% by weight based on the amount of the microfine fibers in the artificial leather.

As described above, if the artificial leather is humidified by spraying steam or water, the artificial leather is prevented from being excessively heated during the shirking treatment. Therefore, the temperature of the artificial leather during the shrinking treatment can be easily controlled to 100° C. or lower. If it is desired to carry out the shrinking treatment effectively by heating the artificial leather to 100° C. or higher, the pre-heating treatment by using hot air or an infrared heater is preferably employed. The pre-heating treatment and the humidifying treatment may be carried out combinedly or simultaneously.

Immediately after step (6), the elastically stretchable artificial leather is cooled preferably to 85° C. or lower. The elastically stretchable artificial leather obtained in step (6) is conveyed preferably by a conveyer belt. If the elastically stretchable artificial leather is immediately cooled, for example, cooled from the heated state at 100° C. or higher to 85° C. or lower by a cooling roll or air cooling, the drawback that the stretchable artificial leather being conveyed under heated state is adversely affected by the process stress can be avoided. The belt conveyer is advantageous because the belt conveys the elastically stretchable artificial leather with it held on the belt even when passing over one roll to another; therefore, the shrunk artificial leather is prevented from being stretched by the process stress. The artificial leather treated with the apparatus shown in FIGS. 1 and 2 (for example, after shrinking treatment and heat treatment) may be transferred to another heat treatment apparatus for heat treatment (heat set). In this case, the artificial leather may be belt-conveyed to the heat treatment apparatus and may be cooled as described above.

The apparent density of the elastically stretchable artificial leather obtained through step (6) is preferably 0.25 to 0.80 g/cm$^3$. Within this range, the abrasion resistance and the processability to various applications are good. The mass per unit area is preferably 150 to 1700 g/m$^2$. The thickness is selected according to the use and preferably 0.5 to 2.0 mm.

In the production method of the invention, the artificial leather is shrunk toward the running direction (machine direction) by compressing from behind. Therefore, the obtained elastically stretchable artificial leather preferably has a micro buckling structure (wave-like structure) formed from bundles of microfine fibers and an optional elastic polymer. With this structure, the elastically stretchable artificial leather has a soft feel and fine folded wrinkles irrespective of its apparent density. The micro buckling structure is a wave-like structure which is formed along the machine direction by the shrinking of the artificial leather in the machine direction. Since the artificial leather of the invention includes the nonwoven fabric comprising microfine fibers, the wave-like structure is easy to form (refer to FIGS. 4 and 5). The wave-like structure is not needed to be continuous and may be discontinuous in the machine direction. The stretchability of the elastically stretchable artificial leather in the machine direction is not attributable to the stretchability of fibers per se, but attributable to the deformation (elongation) of the buckling structure. Therefore, the elastically stretchable artificial leather has a feel of resistance to further stretching, hardly loses its shape by wearing, and is excellent in the wearing comfort and the processability to various applications. The wave-like structure preferably has the features which are mentioned below in detail.

The artificial leather obtained by the production method of the invention does not necessarily have the wave-like structure as mentioned above. Even when the wave-like structure is not present, the bundles of microfine fibers and the optional elastic polymer may be micro-buckled or bent by the mechanical shrinking treatment and the heat setting mentioned above. By relaxing the stressed state of the bundles of microfine fibers and the optional elastic polymer by such micro buckling structure, etc., the elastically stretchable artificial leather thus obtained has some degree of soft feel and fine folded wrinkles irrespective of its apparent density.

The elastically stretchable artificial leather of the invention has a moderate stretchability in the machine direction and therefore shows a good wearing comfort and a good processability to products. In addition, its feel of resistance to further stretching prevents the loss of form and shape by wearing. The stretchability and feel of resistance to further stretching in the machine direction can be evaluated by a stress-elongation curve in the machine direction (load-elongation curve, ordinate: load (stress), abscissa: elongation percentage (elongation)). The elastically stretchable artificial leather of the invention shows, for example, an elongation ((deformation by stretching/length before stretching)×100) of 10 to 40% at a load of 40 N/cm. The feel of resistance to further stretching does not mean the complete prevention of further stretching, but means that the resistance to further stretching becomes extremely large when the elongation exceeds a certain level, thereby making the further stretching difficult. This feel depends on the change of load during stretching. In the present invention, the feel of resistance to further stretching is expressed by the ratio of the load at 30% elongation to the load at 5% elongation (30% elongation/5% elongation) which are determined from a stress-elongation curve in the machine direction (see FIG. 3). The load at 5% elongation largely affects the sewing properties, the processability, and the wearing comfort. Generally, the structure of the nonwoven fabric in artificial leather is largely changed when the elongation exceeds 30%. With such artificial leather, the effect of preventing the loss of form and shape by wearing, which is intended by the present invention, cannot be obtained. Therefore, the load at 30% elongation is employed. The ratio of loads of the elastically stretchable artificial leather specified above is preferably 5 or more, more preferably 5 to 40, and particularly preferably 8 to 40. Within the above ranges, the feel of resistance to further stretching is obtained in the machine direction, the loss of shape by wearing is minimized, and the wearing comfort and the processability to various applications are good.

In the present invention, the machine direction (MD) is the running direction of the production line of artificial leather and the direction perpendicular to MD is the transverse direction. The machine direction of the artificial leather in products can be determined generally by several factors, for example, the orientation direction of bundles of microfine fibers and streaks and marks caused by the needle punching and the jet fluid treatment. If the machine direction cannot be surely determined, for example, when the factors give different machine directions, the bundles of microfine fibers are not oriented definitely, or marks of streak cannot be found, the direction having a maximum tensile stress is determined as the machine direction and the direction perpendicular to it is determined as the transverse direction.

In the production method of the invention, the artificial leather is brought into close contact with the elastomer sheet stretched in the machine direction, and then, the artificial leather is allowed to shrink in the machine direction while allowing the elastomer sheet to shrink in the machine direction. By this shrinking, the elasticity of the artificial leather in the machine direction is enhanced. Thus, the production method of the invention provides an elastically stretchable artificial leather which can be stretched in the machine direction by a lower load as compared with known artificial leathers. Therefore, the elastically stretchable artificial leather of the invention shows a stress-elongation curve in which the load drastically increases when the elongation exceeds a certain level (see FIG. 3). With such characteristics, the elastically stretchable artificial leather of the invention has properties of stretching at a low load in the small elongation region but requiring a high load for stretching in the large elongation region (feel of resistance to further stretching).

The elastically stretchable artificial leather of the invention thus obtained has a moderate elongation and a feel of resistance to further stretching in the machine direction and is excellent in the surface quality, and therefore, applicable to a wide range of uses, for example, clothing, furniture, car seat, and various goods.

Elastically Stretchable Artificial Leather

First to third embodiments of the elastically stretchable artificial leather capable of being produced by the production method described above are explained in detail. The features of each embodiment of the elastically stretchable artificial leather not specifically described below are the same as those described above with respect to the production method.

First Embodiment

Figure 4:
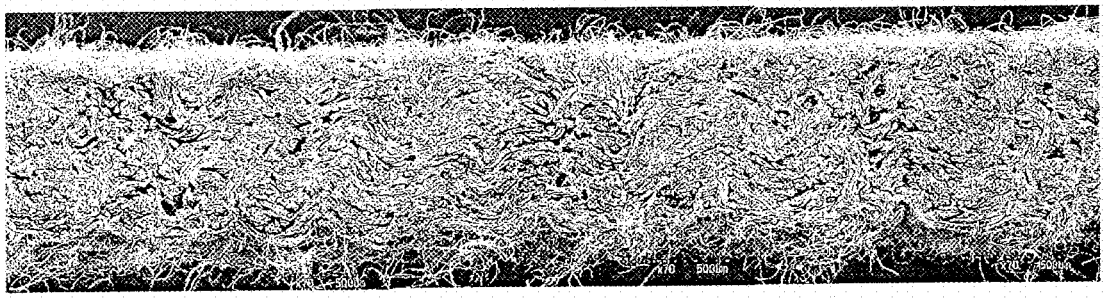
FIG. 4 is a scanning electron microphotograph showing a cross section taken in parallel to the thickness direction and the machine direction of the elastically stretchable artificial leather obtained in Example 1.
Figure 5:
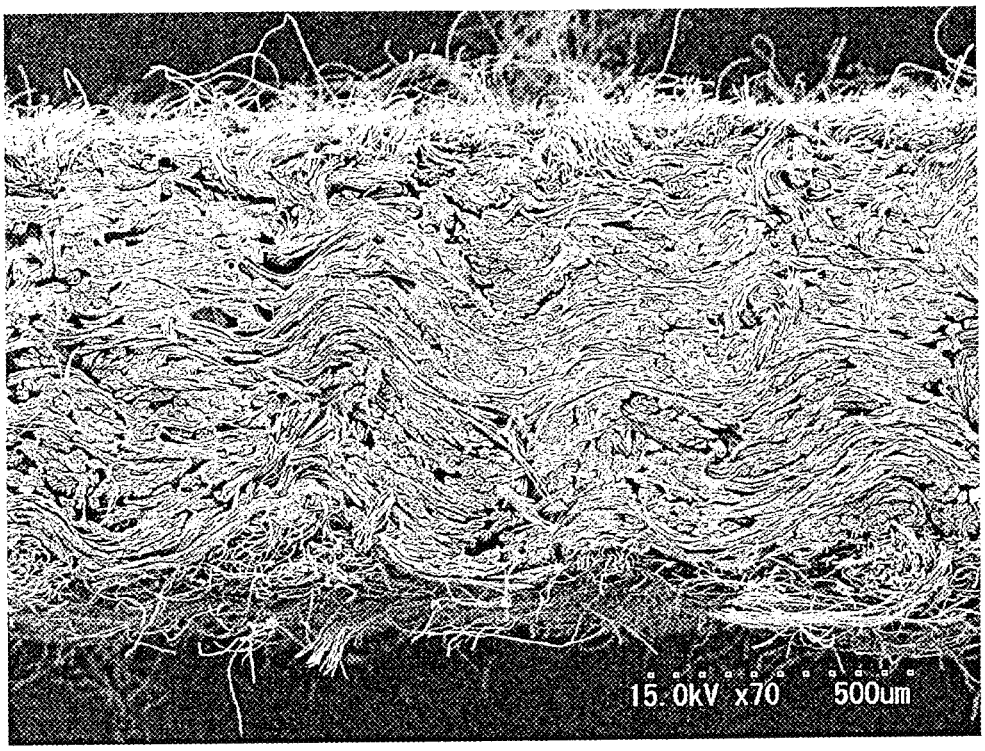
FIG. 5 is a scanning electron microphotograph of showing a cross section taken in parallel to the thickness direction and the machine direction of the elastically stretchable artificial leather obtained in Example 1, which is taken at a magnification higher than that of FIG. 4.

The elastically stretchable artificial leather of the first embodiment is constituted by an entangled fiber body comprising microfine fibers having an average single fiber fineness of 0.9 dtex or less, and has an apparent density of 0.40 g/cm$^3$ or more and a micro wave-like structure on a cross section taken in parallel to both the thickness direction and the machine direction as shown in FIGS. 4 and 5, which comprises microfine fibers and extends along the machine direction. The elastically stretchable artificial leather combines a moderate elasticity and a feel of resistance to further stretching in the machine direction with good mechanical properties because of its high apparent density and the micro wave-like structure. The elastically stretchable artificial leather of this embodiment is preferably produced by the above-mentioned production method of the invention, although the production method is not limited thereto.

Entangled Fiber Body

The entangled fiber body of this embodiment is obtained by making microfine staple fibers, microfine filament fibers, or microfiberizable fibers into a web, for example, in accordance with step (1), entangling the obtained web to obtain an entangled nonwoven fabric in accordance with step (2), and converting the microfiberizable fibers into microfine fibers, for example, in accordance with step (4) if the microfiberizable fibers are used. The details of the materials of the entangled fiber body, the microfine fibers, etc. are omitted here because they are the same as those of the artificial leather obtained by the production method mentioned above.

Elastic Polymer

In the elastically stretchable artificial leather of this embodiment, the entangled fiber body preferably comprises an elastic polymer and the micro wave-like structure is preferably constituted by the microfine fibers and the elastic polymer included in the entangled fiber body. When the microfine fibers are filaments, the wave-like structure is easily formed even when the use of the elastic polymer is omitted and the resultant entangled fiber body does not include the elastic polymer. The elastic polymer is impregnated into the entangled fiber body, for example, by the impregnating treatment of step (3). The treating method and the materials are the same as those mentioned above, and the details thereof are omitted here.

Grain and Nap Finish

The elastically stretchable artificial leather is preferably made into a grain-finished artificial leather, a semi grain-finished artificial leather, a raised artificial leather, or a nubuck-finished artificial leather by forming a grain layer on at least one surface or making at least one surface into a nap raised surface by napping treatment. The grain layer is formed and the surface is napped preferably by the methods as described in step (5).

Wave-Like Structure

The elastically stretchable artificial leather of this embodiment is produced by mechanically shrinking the artificial leather before being mechanically shrink-processed (hereinafter also referred to as "artificial leather before treatment") in the machine direction and then by heat-treating (heat-setting) the artificial leather in shrunk state. By the mechanical shrinking, the micro wave-like structure is formed along the machine direction and then retained by the heat treatment (heat setting). Specifically, the wave-like structure is formed by the buckling of the entangled fiber body comprising the microfine fibers or comprising microfine fibers and the elastic polymer in the machine direction. With this wave-like structure (buckling structure), the shrinkable artificial leather has a soft feel and fine folded wrinkles irrespective of its high apparent density. The wave-like structure is not needed to be continuous and may be discontinuous in the machine direction.

The wave-like structure is characterized that the number of pitch per 1 mm length in the machine direction is 2.2 or more, the average height (height difference between peak and valley) is 50 to 350 μm, and the average pitch is 450 μm or less. The average pitch referred to herein is an average of the distances of one pitch (distance between a valley and the next peak, or between a peak and the next valley), and the number of pitch is the number of pitches which occur per 1 mm distance. The moderate stretchability and a feel of resistance to further stretching in the machine direction of the elastically stretchable artificial leather of the invention is not attributable to the stretchability of fibers per se, but attributable to the deformation (elongation) of the wave-like structure. The moderate stretchability in the machine direction of the elastically stretchable artificial leather makes the wearing comfort and the processability to products good. The moderate feel of resistance to further stretching prevents the loss of form and shape by wearing.

The number of pitch is preferably 2.2 to 6.7 and more preferably 2.5 to 5.0. The average pitch is preferably 150 to 450 μm and more preferably 200 to 400 μm. If the number of pitch is within the above ranges, the feel of resistance to further stretching is enhanced to make the loss of shape by wearing difficult to occur, and further, the stretchability in the machine direction, the wearing comfort, and the processability are made good.

The average height is more preferably 100 to 300 μm. Within this range, a better stretchability in the machine direction and a better feel of resistance to further stretching are obtained, and in addition, an artificial leather excellent in flatness, smoothness, and appearance is obtained because the surface roughness can be controlled.

In this embodiment, during the mechanical shrinking in the machine direction, the artificial leather is shrunk not so much or substantially not shrunk in the transverse direction as compared with the shrinking in the machine direction. Therefore, the micro wave-like structure extending along the transverse direction is nearly not found on the cross section taken in parallel to both the thickness direction and the transverse direction. Even if formed, the amount of waves of the wave-like structure observed on the cross section taken in parallel to both the thickness direction and the transverse direction is smaller than that of the wave-like structure observed on the cross section taken in parallel to both the thickness direction and the machine direction. Namely, the number of pitch (per 1 mm distance) and the average height of the wave-like structure extending along the machine direction are larger than those of the wave-like structure extending along the transverse direction, respectively.

The micro wave-like structure and the moderate stretchability in the machine direction of the elastically stretchable artificial leather of this embodiment make the wearing comfort and the processability to products good. The moderate feel of resistance to further stretching prevents the loss of form and shape by wearing. The stretchability and feel of resistance to further stretching in the machine direction can be evaluated by a stress-elongation curve in the machine direction (ordinate: load, abscissa: elongation) and the 5% circular modulus in the machine direction. The elastically stretchable artificial leather of this embodiment shows, for example, an elongation ((deformation by stretching/length before stretching)×100) of 10 to 40% at a load of 40 N/cm. The 5% circular modulus in the machine direction is an index for the stretchability at low elongation and can be regulated, for example, within 40 N or less and preferably 10 to 30 N by forming the wave-like structure.

The feel of resistance to further stretching does not mean the complete prevention of further stretching, but means that the resistance to further stretching becomes extremely large when the elongation exceeds a certain level, thereby making the further stretching difficult. This feel depends on the change of load during stretching. In this embodiment, the feel of resistance to further stretching is expressed by the ratio of the load at 30% elongation to the load at 5% elongation (30% elongation/5% elongation) which are determined from a stress-elongation curve in the machine direction (see FIG. 3). The ratio of loads of the elastically stretchable artificial leather specified above is preferably 5 or more, more preferably 5 to 40, and most preferably 8 to 40. Within the above ranges, the feel of resistance to further stretching is obtained in the machine direction, the loss of shape by wearing is minimized, and the wearing comfort and the processability to various applications are good.

Apparent Density and Mass Per Unit Area

The apparent density of the elastically stretchable artificial leather of this embodiment is 0.40 g/cm$^3$ or more. Within the above range, the voids in the artificial leather are reduced to facilitate the formation of the wave-like structure by the mechanical shrinking treatment. In addition, the tear strength and the peeling strength are enhanced, particularly, the feel of resistance to further stretching is enhanced. Therefore, a high strength artificial leather is obtained while retaining the stretchability in the machine direction by the wave-like structure. The apparent density is more preferably 0.45 g/cm$^3$ or more and still more preferably 0.50 g/cm$^3$ or more. The apparent density is also preferably 0.80 g/cm$^3$ or less, more preferably 0.70 g/cm$^3$ or less, and still more preferably 0.65 g/cm$^3$ or less. If being 0.80 g/cm$^3$ or less, the processability to various applications is made good.

The mass per unit area of the elastically stretchable artificial leather is preferably 150 g/m$^2$ or more, more preferably 200 g/m$^2$ or more, and still more preferably 250 g/m$^2$ or more. The mass per unit area is also preferably 1500 g/m$^2$ or less, more preferably 1200 g/m$^2$ or less, and still more preferably 1000 g/m$^2$ or less. If being 150 g/m$^2$ or more, a good rebound feel is easily obtained. If being 1500 g/m$^2$ or less, the processability to various applications tends to become good. The thickness is selected according to the use and is 0.35 to 2.00 mm and preferably 0.40 to 1.50 mm. Since the mechanical shrinking treatment and the heat-setting treatment are employed in this embodiment, the apparent density and the mass per unit area of the elastically stretchable artificial leather are larger than those of the artificial leather before treatment, i.e., the artificial leather before mechanically shrink-treated, respectively.

Formation of Wave-Like Structure

The micro wave-like structure along the machine direction is formed by mechanically shrinking the artificial leather before treatment in the machine direction and then heat-setting in shrunk state.

In an example of the mechanical shrinking treatment of this embodiment, a thick elastomer sheet (for example, rubber sheet and felt) with a thickness of several centimeters or more is stretched in the machine direction; the artificial leather before treatment is brought into close contact with the stretched surface of the elastomer sheet; and the stretched surface is allowed to elastically recover from the stretched state to the state before stretching, thereby shrinking the artificial leather before treatment in the machine direction. The mechanical shrinking treatment is carried out preferably in the manner as in step (6) mentioned above in detail.

In this embodiment, since the artificial leather before treatment is shrunk in the running direction (machine direction) while being pushed from behind, the micro buckling structure (wave-like structure) mentioned above is formed in the obtained elastically stretchable artificial leather. Since the nonwoven fabric of the artificial leather is a high density structure comprising microfine fibers, the micro wave-like structure can be easily formed.

Artificial Leather Before Treatment

As described above, the artificial leather before treatment of this embodiment, i.e., the artificial leather before the heat-shrinking treatment, is obtained by making microfine staple fibers, microfine filament fibers, or microfiberizable fibers into a web; entangling the obtained web to form an entangled nonwoven fabric; and then optionally carrying out a process of impregnating an elastic polymer, a process of converting the microfiberizable fibers into microfine fibers, and a process of grain- or nap-finishing the surface if need arises. These treatments are carried out, for example, by the methods of steps (1) to (5) described above.

The apparent density of the artificial leather before treatment is preferably 0.25 to 0.80 g/cm$^3$, more preferably 0.30 to 0.70 g/cm$^3$, and most preferably 0.40 to 0.70 g/cm$^3$. Within the above ranges, the voids in the entangled fiber body of the artificial leather before treatment are minimized; the formation of the wave-like structure by the heat-shrinking treatment is facilitated; and the processability is good. The mass per unit area is preferably 130 to 1600 g/m$^2$ and more preferably 150 to 1400 g/m$^2$. The thickness is preferably 0.2 to 2.0 mm and more preferably 0.5 to 2.0 mm.

As described above, the elastically stretchable artificial leather of this embodiment has a high apparent density and a wave-like structure, and therefore, acquires a mechanical strength, a feel of resistance to further stretching and a high quality surface while having a moderate stretchability in the machine direction. With these properties, the elastically stretchable artificial leather is applicable to a wide range of uses, for example, clothing, furniture, car seats, and various goods. The wave-like structure of the elastically stretchable artificial leather can be easily formed by shrinking the artificial leather in the machine direction and then heat-setting.

Second Embodiment

The elastically stretchable artificial leather of the second embodiment is produced, for example, by the production method mentioned above and has the following properties. The elastically stretchable artificial leather of the second embodiment is described below in detail, and the features not specifically described below are the same as those described above with respect to the elastically stretchable artificial leather of the first embodiment.

Elastically Stretchable Artificial Leather

The elastically stretchable artificial leather of the second embodiment comprises an entangled fiber body of microfine fibers having an average single fiber fineness of 0.9 dtex or less and has an apparent density of 0.40 g/cm$^3$ or more and an elongation factor of 50 or less when calculated from the following formula (1):

$$\text{Elongation factor} = \text{5\% circular modulus in machine direction/thickness} \quad (1).$$

With its high apparent density and good elongation factor, the elastically stretchable artificial leather of this embodiment exhibits good mechanical properties while having a moderate elasticity and a feel of resistance to further stretching in the machine direction.

Elongation Factor and Feel of Resistance to Further Stretching

The elastically stretchable artificial leather of this embodiment is characterized by an elongation factor of 50 or less which is obtained by dividing the 5% circular modulus in the machine direction by the thickness as described above. The 5% circular modulus is an index for the stretchability at low elongation and exhibits the stretching properties of the elastically stretchable artificial leather, which increases with increasing thickness and decreases with decreasing thickness. Therefore, the 5% circular modulus changes depending upon the thickness even when the artificial leather is formed from the entangled fiber body of the same structure. In contrast, since the 5% circular modulus is divided by the thickness, the elongation factor used in this embodiment is independent of the thickness and shows the stretching properties which are attributable to the fiber structure itself of the elastically stretchable artificial leather.

Regardless of its good mechanical strength attributable to a high apparent density, the elastically stretchable artificial leather of this embodiment shows a good stretchability at low elongation because of its elongation factor within the above ranges. The elongation factor is preferably 5 to 40 and more preferably 10 to 25. If within these ranges, the mechanical strength of the elastically stretchable artificial leather can be also improved more while improving the stretchability at low elongation more. Although the elastically stretchable artificial leather has a thickness of a certain level or more as described above, the 5% circular modulus can be regulated, for example, within 40 N or less and preferably 10 to 30 N by controlling the elongation factor to 50 or less. Therefore, the elastically stretchable artificial leather of this embodiment has a good stretchability at low elongation while having a thickness enough to ensure the strength required for artificial leather.

With a good 5% circular modulus and a moderate stretchability, the elastically stretchable artificial leather of this embodiment has a wearing comfort and a good processability to products. The properties that the apparent density is high but low in the elongation factor make it possible to provide a moderate feel of resistance to further stretching. With this feel of resistance to further stretching, the elastically stretchable artificial leather prevents the loss of form and shape by wearing.

As described above, the feel of resistance to further stretching can be evaluated from a stress-elongation curve in the machine direction (ordinate: load, abscissa: elongation). In this embodiment, the ratio of the load at 30% elongation to the load at 5% elongation (30% elongation/5% elongation) determined from a stress-elongation curve in the machine direction (see FIG. 3) is 5 or more, more preferably 5 to 40, and particularly preferably 8 to 40. Within the above ranges, the feel of resistance to further stretching in the machine direction is obtained, the loss of shape by wearing is minimized, and the wearing comfort and the processability to various uses are good.

Like the 5% circular modulus, the stress-elongation curve can be used also for evaluating the stretchability in the machine direction. The elastically stretchable artificial leather of this embodiment preferably shows an elongation ((deformation by stretching/length before stretching)×100) of 10 to 40% at a load of 40 N/cm.

Like the elastically stretchable artificial leather of the first embodiment, the elastically stretchable artificial leather of this embodiment preferably has a micro wave-like structure comprising microfine fibers in the machine direction on a cross section taken in parallel to both the thickness direction and the machine direction. By this micro wave-like structure, the elongation factor can be made low even when the apparent density is high, as described above. Since the micro wave-like structure and its forming method are the same as those of the first embodiment, the details thereof are omitted here.

In addition, since the apparent density, the mass per unit area, and other features of the artificial leather before treatment and the elastically stretchable artificial leather of this embodiment are the same as those of the elastically stretchable artificial leather of the first embodiment, the details thereof are also omitted here.

Even if the elastically stretchable artificial leather fails to have the micro wave-like structure, an elongation factor relatively low can be obtained as long as it is produced by the production method mentioned above, because the bundles of microfine fibers and the optional elastic polymer may be micro-buckled or bent.

As described above, the elastically stretchable artificial leather of this embodiment has a low elongation factor although the apparent density is made high. Therefore, if the thickness is appropriate for artificial leather, the stretchability at low elongation in the machine direction can be improved while maintaining the mechanical strength sufficient. By combining the low elongation factor and the high apparent density, an artificial leather having a soft and flexible hand with a dense feel can be obtained. With these features, the elastically stretchable artificial leather of this embodiment is applicable to a wide range of use, for example, clothing, furniture, car seats, and various good. In addition, the elongation factor of the elastically stretchable artificial leather can be made low by forming the micro wave-like structure even if the apparent density is made high.

Third Embodiment

Elastically Stretchable Artificial Leather

The elastically stretchable artificial leather of the third embodiment has the following features.

The elastically stretchable artificial leather of the third embodiment satisfies the following requirements (A) and (B) when determined from a stress-elongation curve in the machine direction which is obtained according to the method of JIS L 1096 (1999) 8.14.1 A for elastic artificial leather:

(A) a stress $F_{5\%}$ at 5% elongation is 0.1 to 10 N/2.5 cm, and (B) the ratio of a stress $F_{20\%}$ at 20% elongation and the stress $F_{5\%}$, $F_{20\%}/F_{5\%}$, is 5 or more.

In this embodiment, the stress-elongation curve is obtained according to JIS L 1096 (1999) 8.14.1 Method A. A test piece with 2.5 cm width is held between chucks at an interval of 20 cm and stretched at a constant speed to measure the stress at each elongation. From the measured results, the stress-elongation curve wherein the abscissa is the elongation (%) and the ordinate is the stress per 2.5 cm width (N/2.5 cm) of the test is obtained.

Figure 8:
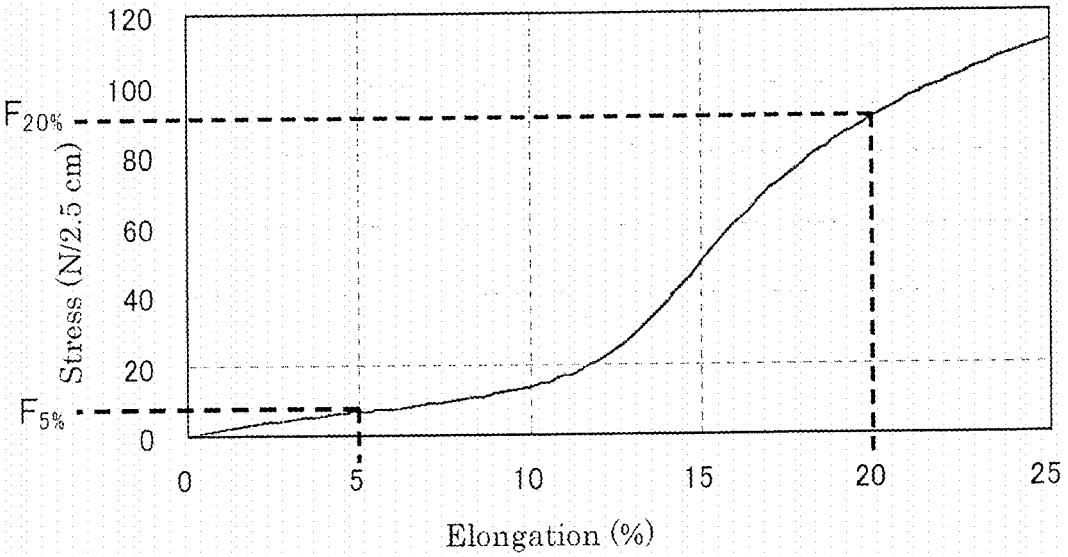
FIG. 8 is a model of a stress-elongation curve in the machine direction of the elastically stretchable artificial leather of the invention, which is to be obtained according to JIS L 1096 (1999) 8.14.1 A.

FIG. 8 is a model of a stress-elongation curve in the machine direction of the elastically stretchable artificial leather of this embodiment, which is to be obtained according to JIS L 1096 (1999) 8.14.1 A.

The curve of FIG. 8 shows a stress-elongation curve in the machine direction. The elongation is defined as follows:

Elongation=[(length after stretching)−(length before stretching)]/length before stretching×100.

The elastically stretchable artificial leather of this embodiment satisfies a requirement (A): a stress $F_{5\%}$ at 5% elongation is 0.1 to 20 N/2.5 cm. Within the above range, a moderate flexibility is obtained because the elastic deformation is smooth. The stress $F_{5\%}$ is preferably 0.2 to 15 N/2.5 cm and more preferably 0.3 to 10 N/2.5 cm.

The elastically stretchable artificial leather of this embodiment satisfies a requirement (B): a ratio of a stress $F_{20\%}$ at 20% elongation and $F_{5\%}$, $F_{20\%}/F_{5\%}$, is 5 or more. With being within the above range, a large stress is caused when stretched to 20% elongation to provide a suitable feel of resistance to further stretching, this enhancing the shape stability of leather products to make the shape being hardly lost. The stress at 5% elongation largely affects the sewing properties, the processability, and the wearing comfort. Generally, the structure of nonwoven fabric forming an artificial leather is largely changed when the artificial leather is stretched exceeding 20% elongation. Such artificial leather cannot have an effect of preventing the loss of form and shape by wearing, which is aimed in this embodiment. For this reason, the stress at 20% elongation has been employed.

The ratio of $F_{20\%}/F_{5\%}$ is preferably 8 or more, more preferably 10 or more, and still more preferably 20 or more. The upper limit is, for example, 100 although not limited thereto. Within the above ranges, a feel of resistance to further stretching in the machine direction is obtained, the loss of shape by wearing is minimized, and the wearing comfort and the processability to a wide range of use are good.

The elastically stretchable artificial leather of this embodiment preferably satisfies a requirement (C): a ratio of a slope $S_{20\%}$ of a tangent line to the curve at 20% elongation and a slope $S_{5\%}$ of a tangent line to the curve at 5% elongation, $S_{20\%}/S_{5\%}$, is 1.2 or more. Within the above range, the tensile stress at around 20% elongation increases markedly to make the feel of resistance to further stretching more remarkable. $S_{20\%}/S_{5\%}$ is preferably 5 or more and more preferably 10 or more. The upper limit is, for example, 100 although not particularly limited thereto.

The elastically stretchable artificial leather of this embodiment preferably satisfies a requirement (D): the maximum slope $S_{0\ to\ 5\%\ max}$ of tangent lines to the curve from zero elongation to 5% elongation is 8 or less. If satisfying this requirement, the resistance to stretching is small at low elongation to ensure a smooth stretching and provide a moderate flexibility. $S_{0\ to\ 5\%\ max}$ is preferably 5 or less and more preferably 3 or less. The lower limit is, for example, 0.1 although not particularly limited thereto.

The elastically stretchable artificial leather of this embodiment preferably satisfies a requirement (E): $F_{20\%}$ is 30 to 200 N/2.5 cm. Within the above range, a large stress is caused when stretched to 20% elongation to provide a suitable feel of resistance to further stretching, this enhancing the shape stability of leather products to make the shape being hardly lost. $F_{20\%}$ is preferably 50 to 190 N/2.5 cm or more and more preferably 80 to 180 N/2.5 cm.

The elastically stretchable artificial leather of this embodiment preferably satisfies a requirement (F): the stress $F_{10\%}$ at 10% elongation is 5 to 60 N/2.5 cm. Within the above range, a moderate tensile stress is caused when stretched to 10% elongation to provide a suitable feel of resistance to further stretching. $F_{10\%}$ is preferably 10 to 40 N/2.5 cm and more preferably 10 to 30 N/2.5 cm.

The artificial leather satisfying the requirements (A) to (F) can be produced by selecting the microfine fiber and the entangled fiber body for the substrate, regulating the density, and adjusting the mechanical shrinking treatment on the basis of the technical knowledge of a skilled person. The artificial leather of this embodiment is produced, for example, by the production method mentioned above and has the features of the elastically stretchable artificial leather of one or both of the first and second embodiments.

The elastically stretchable artificial leather of this embodiment has a moderate stretchability in the machine direction and therefore shows a good wearing comfort and a good processability to products. In addition, its feel of resistance to further stretching prevents the loss of form and shape by wearing.

The elastically stretchable artificial leather of this embodiment is preferably produced by bringing the artificial leather into close contact with the elastomer sheet stretched in the machine direction, and then, allowing the elastomer sheet to shrink in the machine direction, thereby allowing the artificial leather to simultaneously shrink in the machine direction. By the shrinking in such manner, the elasticity of the artificial leather in the machine direction is improved to make the artificial leather easily stretchable in the machine direction by a low stress, and therefore, the requirements (A) to (F) are easily satisfied.

In addition, the requirements (A) to (F) can be easily satisfied by forming the wave-like structure mentioned above.

As described above, the elastically stretchable artificial leather of this embodiment has a moderate stretchability and a feel of resistance to further stretching in the machine direction and is excellent in surface quality, and therefore, is applicable to a wide range of use, for example, clothing, furniture, car seats, and various good.

EXAMPLES

The present invention is described in more detail with reference to the examples. However, it should be noted that the scope of the invention is not limited to the following examples. The properties referred to in the examples were measured by the following methods.

(1) Mass Per Unit Area and Apparent Density

The mass per unit area was measured by the method described in JIS L 1096 8.4.2 (1999). The thickness was measured using a dial thickness gauge ("Peacock H" trade name of Ozaki Mfg. Co., Ltd.) and the mass per unit area was divided by the measured thickness to determine the apparent density.

(2) Stiffness (Index for Flexibility when Bending)

The stiffness was measured according to JIS L 1096 8.19.5 Method E (handle O meter method). A test piece (machine direction: 10 cm, transverse direction: 10 cm) was placed on the slit having 20 mm width formed on the test stand. The resistance (g) when the test piece was pushed into the slit to a depth of 8 mm by a blade was measured. The measurement was repeated in the machine direction and the transverse direction of top and back surfaces.

(3) Stress-Elongation Curve

The stress-elongation curve was measured according to JIS L 1096 (1999) 8.14.1 Method A. A test piece with 2.5 cm width was held between chucks at an interval of 20 cm and stretched at a constant speed to measure the stress at each elongation. From the measured results, the stress-elongation curve wherein the abscissa was the elongation (%) and the ordinate was the stress per 2.5 cm width (N/2.5 cm) was obtained.

(4) Feel of Resistance to Further Stretching

The load (stress) at 30% elongation and the load (stress) at 5% elongation were read from the stress-elongation curve obtained above, and the ratio of the loads (30% elongation/5% elongation) was calculated. The measurement was repeated three times and the averaged value was rounded to one decimal. The results were rated as "A" for a sufficient feel of resistance to further stretching (the ratio was 5 or more), "B" for a relatively good feel of resistance to further stretching, and otherwise "C."

(5) Elongation (Load: 40 N/cm)

The elongation in the machine direction at a load of 40 N/cm was read from the stress-elongation curve.

(6) Average Single Fiber Fineness

The cross-sectional areas of 100 fibers randomly selected were measured under an optical microscope and the number averaged value was calculated. The fineness was calculated from the averaged value of the cross-sectional area and the specific gravity of fiber. The specific gravity was measured according to JIS L 1015 8.14.2 (1999).

(7) 5% Circular Modulus (N)

Figure 9:
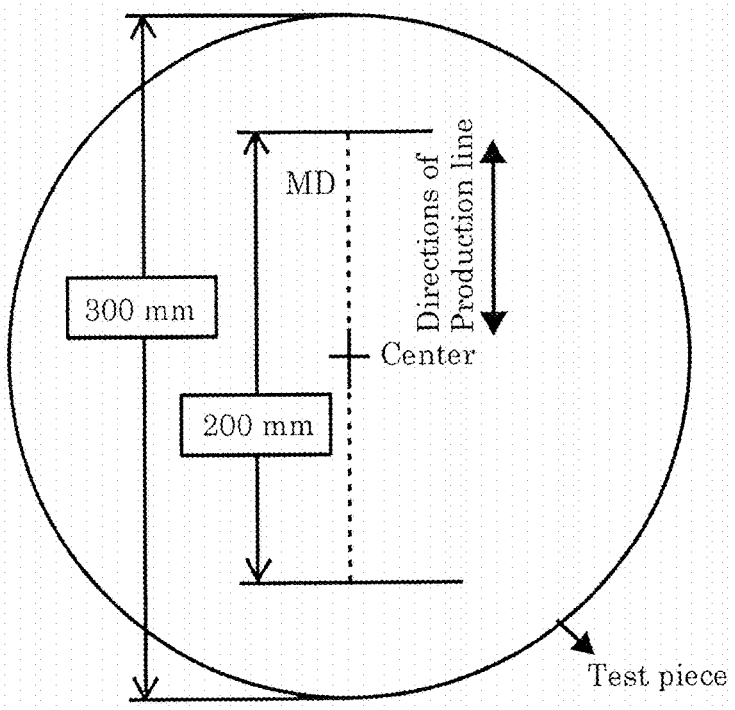
FIG. 9 is a schematic view for illustrating a measuring method of 5% circular modulus.

As shown in FIG. 9, a gauge mark in the machine direction was drawn on the central portion of a line extending along the machine direction having the interval of 200 mm on a circular test piece of 300 mm in diameter. Then, the test piece was measured for the modulus at 5% elongation at a chuck interval of 200 mm and a tensile speed of 200 mm/min by using Instron tensile tester.

(8) Evaluation of Wave-Like Structure

On a scanning electron microphotograph of a cross section taken in parallel to both the thickness direction and the machine direction of an elastically stretchable artificial leather, an interval of 5.0 mm was selected along the machine direction at an arbitrary position in the thickness direction. The pitches (i.e., from a valley to the next peak, and from a peak to the next valley) of the wave-like structure which occurred in the interval were counted. The results were averaged and the number of pitch occurred per 1 mm was calculated. The height difference between a peak and a valley that are next to each other in the wave-like structure in the 5.0 mm interval was measured. The results were averaged to obtain the average height of the wave-like structure. The distance of the pitch was measured along the machine direction, and the results were averaged to obtain the average pitch. The height differences between a peak and a valley that are next to each other were measured along the thickness direction.

Example 1

A water-soluble, thermoplastic, ethylene-modified polyvinyl alcohol (modified PVA, sea component, modification degree: 10 mol %) and a 6 mol % isophthalic acid-modified polyethylene terephthalate (modified PET, island component) were extruded from a spinneret for melt composite spinning (number of islands: 25/fiber) at 260° C. in a sea component/island component ratio of 25/75 (by mass). The ejector pressure was adjusted such that the spinning speed was 3700 m/min, and sea-island filaments having an average fineness of 2.1 dtex were collected on a net. Then, the sheet of sea-island filaments on the net was slightly pressed by a metal roll of a surface temperature of 42° C. to prevent the surface from fluffing. Thereafter, the sheet was peeled off from the net and then was hot-pressed between a metal roll (lattice pattern) of a surface temperature of 75° C. and a back roll to obtain a filament web having a mass per unit area of 34 g/m$^2$ in which the fibers on the surface were temporarily fuse-bonded in lattice pattern.

After providing an oil agent and an antistatic agent, the filament web was cross-lapped into 14 layers to prepare a lapped web having a total mass per unit area of 480 g/m$^2$, which was then sprayed with an oil agent for preventing needle break. The lapped web was needle-punched at 3300 punch/cm$^2$ alternatively from both sides using 6-barb needles with a tip-to-first barb distance of 3.2 mm at a punching depth of 8.3 mm. The areal shrinkage by the needle punching was 68% and the mass per unit area of the entangled nonwoven fabric after needle punching was 580 g/m$^2$.

After adding 10% by mass of water, the entangled nonwoven fabric was allowed to shrink by a heat treatment at 70° C. in an atmosphere of 95% relative humidity to increase the apparent density, thereby obtaining a densified nonwoven fabric. The areal shrinkage by the densifying treatment was 45%, and the obtained nonwoven fabric had a mass per unit area of 1050 g/m$^2$ and an apparent density of 0.52 g/cm$^3$. The densified nonwoven fabric was then roll-pressed under dry heat, impregnated with an aqueous polyurethane emulsion, and dried and cured at 150° C., to obtain a nonwoven fabric sheet impregnated with elastic polymer. Thereafter, PVA was removed by dissolving in a hot water at 95° C., to obtain a substrate for artificial leather having a resin-to-fiber ratio R/F of 12/88.

Figure 6:
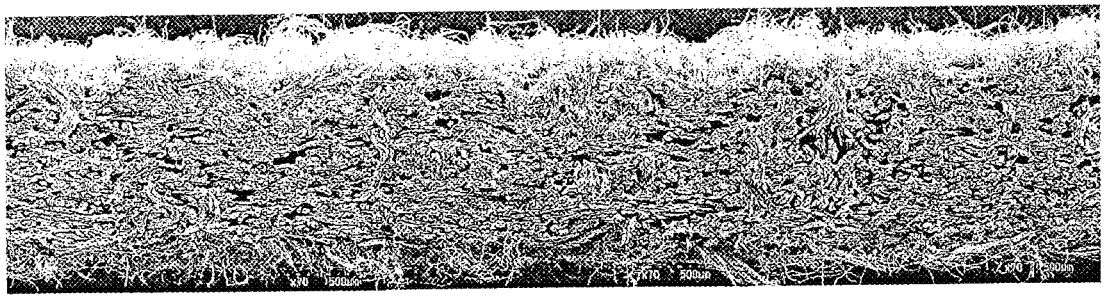
FIG. 6 is a scanning electron microphotograph showing a cross section taken in parallel to the thickness direction and the machine direction of the artificial leather not subjected to shrinking process of Comparative Example 1.
Figure 7:
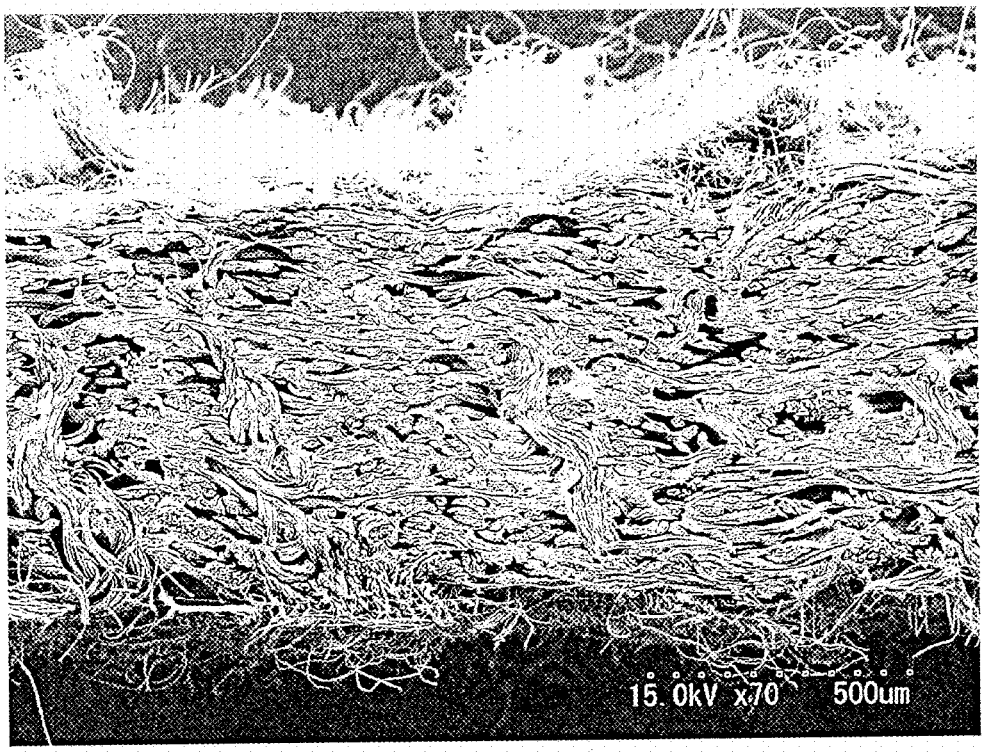
FIG. 7 is a scanning electron microphotograph showing a cross section taken in parallel to the thickness direction and the machine direction of the artificial leather not subjected to shrinking process of Comparative Example 1, which is taken at a magnification higher than that of FIG. 6.

The obtained substrate for artificial leather was divided into two pieces by slicing in parallel to the main surface, and the divided surface was buffed with sandpaper to make the thickness uniform (thickness: 0.75 mm). The surface opposite to the divided surface was napped by sandpaper, and the raised naps were ordered. The treated substrate for artificial leather was then dyed with a disperse dye by using a jet dyeing machine, dried, and brushed for finish of ordering raised naps, to obtain a raised artificial leather (thickness: 0.8 mm, mass per unit area: 377 g/m$^2$, apparent density: 0.471 g/cm$^3$). The stress-elongation curve of the raised artificial leather in the machine direction is shown in FIG. 3 (Comparative Example 1), and the scanning electron microphotographs of the cross section taken in parallel to the thickness direction and the machine direction are shown in FIGS. 6 and 7.

The raised artificial leather was shrunk in the machine direction (lengthwise direction) by 9.2% at a feeding speed of 10 m/min by using a shrinking apparatus (sanforizing machine manufactured by Komatsubara Tekko), to obtain an elastically stretchable artificial leather. The shrinking apparatus comprised a humidifying zone, a shrink-heating zone (shrinking apparatus shown in FIG. 1) where the artificial leather continuously fed from the humidifying zone was shrunk and heated, and a heat set zone having a drum for further heat-treating (heat setting) the artificial leather which was shrunk in the shrink-heating zone. The artificial leather was humidified and heated by steam in the humidifying zone so as to raise the temperature of the artificial leather to 45° C. The drum temperature of the shrink-heating zone was 120° C., and the drum temperature of the heat set zone was 120° C. Moreover, the artificial leather was sprayed with air of 25° C. or less to cool down to 70° C. or less immediately after peeling off from the elastomer sheet and immediately after passing through the heat set zone. The artificial leather was conveyed from the shrink-heating zone to the heat set zone by a belt, and also conveyed by a belt after heat setting in the heat set zone.

Figure 3:
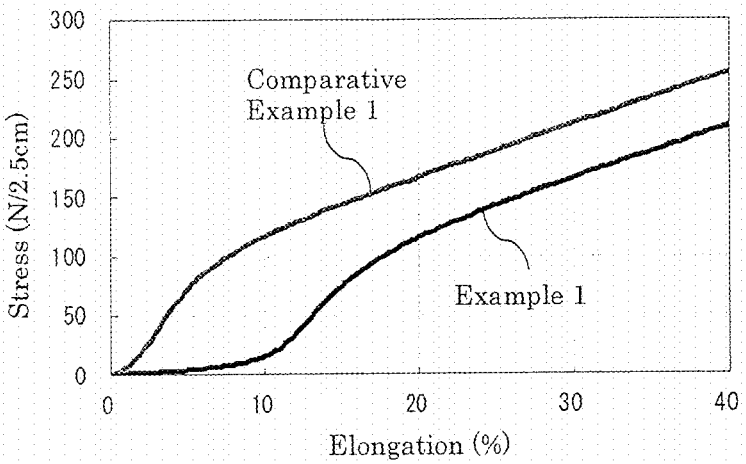
FIG. 3 is a diagram showing stress-elongation curves (S-S curve) in the machine direction of the elastically stretchable artificial leather of Example 1 and the artificial leather not subjected to shrinking process of Comparative Example 1.
Figure 10:
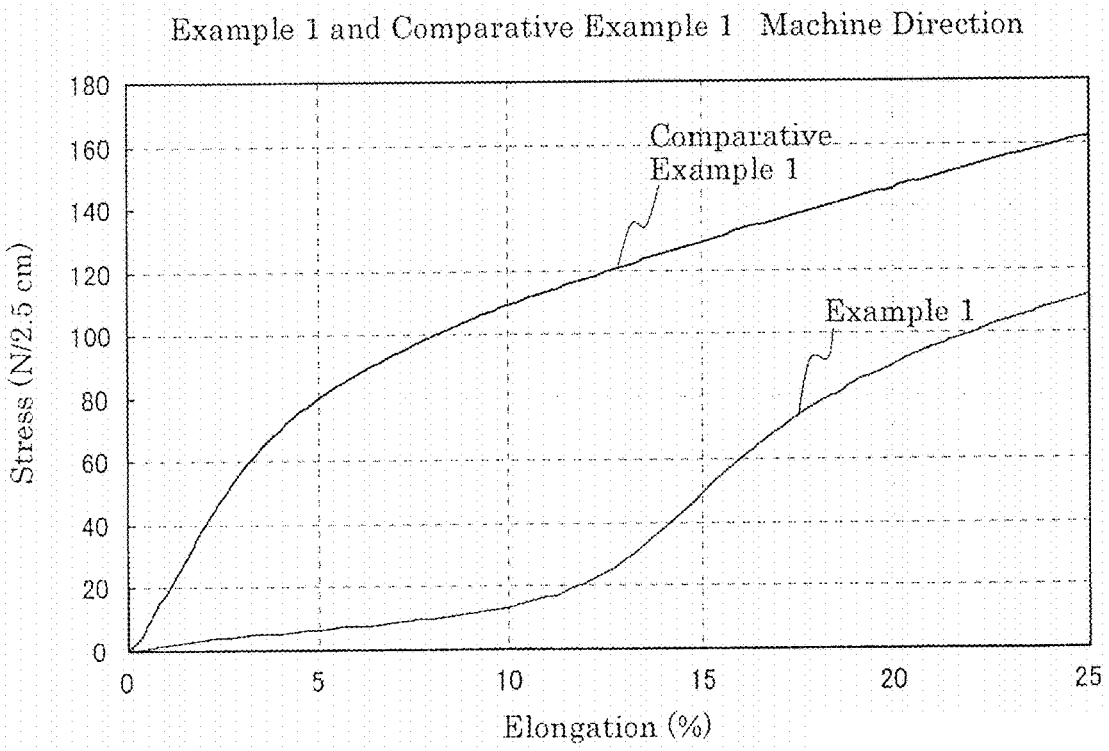
FIG. 10 is a stress-elongation curve in the machine direction of each artificial leather of Example 1 and Comparative Example 1, which is determined according to JIS L 1096 (1999) 8.14.1 A.
Figure 11:
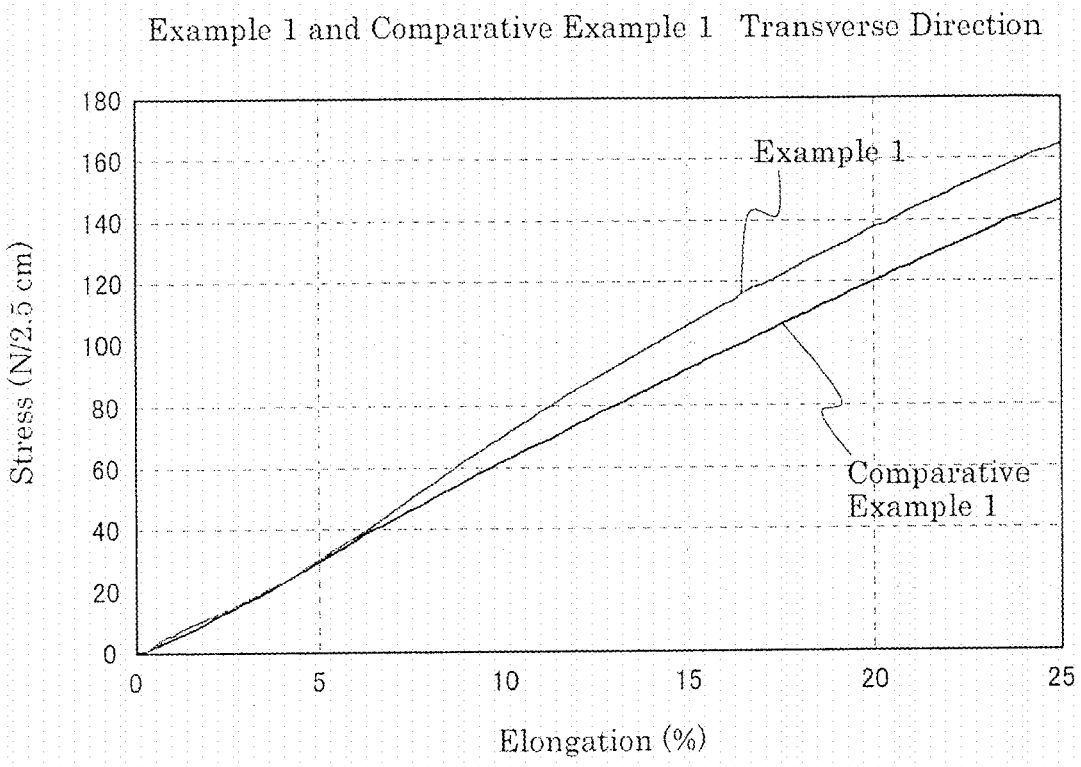
FIG. 11 is a stress-elongation curve in the transverse direction of each artificial leather of Example 1 and Comparative Example 1, which is determined according to JIS L 1096 (1999) 8.14.1 A.

The stress-elongation curve in the machine direction of the elastically stretchable artificial leather is shown in FIG. 3, and the enlarged stress-elongation curves in the machine direction and the transverse direction are shown in FIGS. 10 and 11, respectively. The scanning electron microphotographs of the cross sections taken in parallel to the thickness direction and the machine direction are shown in FIGS. 4 and 5. The evaluation results of the obtained elastically stretchable artificial leather are shown in Table 1.

Example 2

A web was produced by carding and crosslapping by using sea-island composite staple fibers composed of a 6 mol % isophthalic acid-modified polyethylene terephthalate as the island component and polyethylene as the sea component (island component:sea component=60:40 (by mass); fineness: 4.0 dtex; fiber length: 51 mm; number of crimps: 12 crimp/inch).

The web was entangled by needle punching at 1200 punch/cm$^2$ and shrunk in a hot water of 90° C., to obtain an entangled nonwoven fabric with a mass per unit area of 750 g/m$^2$.

After impregnating a 15% dimethylformamide (DMF) solution of a polyether-based polyurethane, the entangled nonwoven fabric was immersed in a bath of a mixed solution of DMF and water to wet-coagulate the polyurethane. After removing the remaining DMF by washing with water, the sea component polyethylene was removed by extraction in a toluene bath at 85° C. The remaining toluene was azeotropically removed in a hot water bath at 100° C. and the entangled nonwoven fabric thus treated was dried, to obtain a substrate for artificial leather having a mass per unit area of 675 g/m$^2$ and thickness of 1.5 mm.

The back surface of the obtained substrate for artificial leather was buffed twice by 180-grit sandpaper to adjust the thickness to 0.65 mm while making the back surface flat and smooth. Next, the top surface was then buffed twice by 240-grit sandpaper and twice by 400-grit sandpaper successively, to obtain a raised artificial leather having a raised nap surface of polyethylene terephthalate microfine fibers.

After dyeing with a disperse dye by using a jet dyeing machine, drying, and brushing for ordering finish, a dyed, raised artificial leather (thickness: 0.65 mm, mass per unit area: 304 g/m$^2$, apparent density: 0.468 g/cm$^3$) was obtained.

The dyed, raised artificial leather was shrunk by 3% in the machine direction in the same manner as in Example 1 by using a shrinking apparatus.

Figure 12:
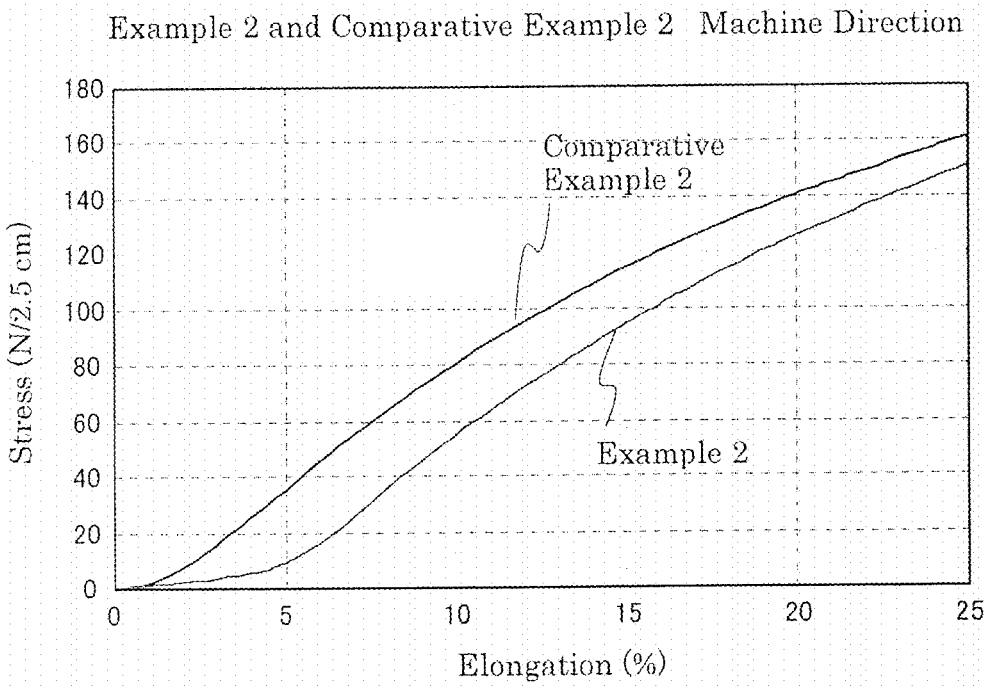
FIG. 12 is a stress-elongation curve in the machine direction of each artificial leather of Example 2 and Comparative Example 2, which is determined according to JIS L 1096 (1999) 8.14.1 A.
Figure 13:
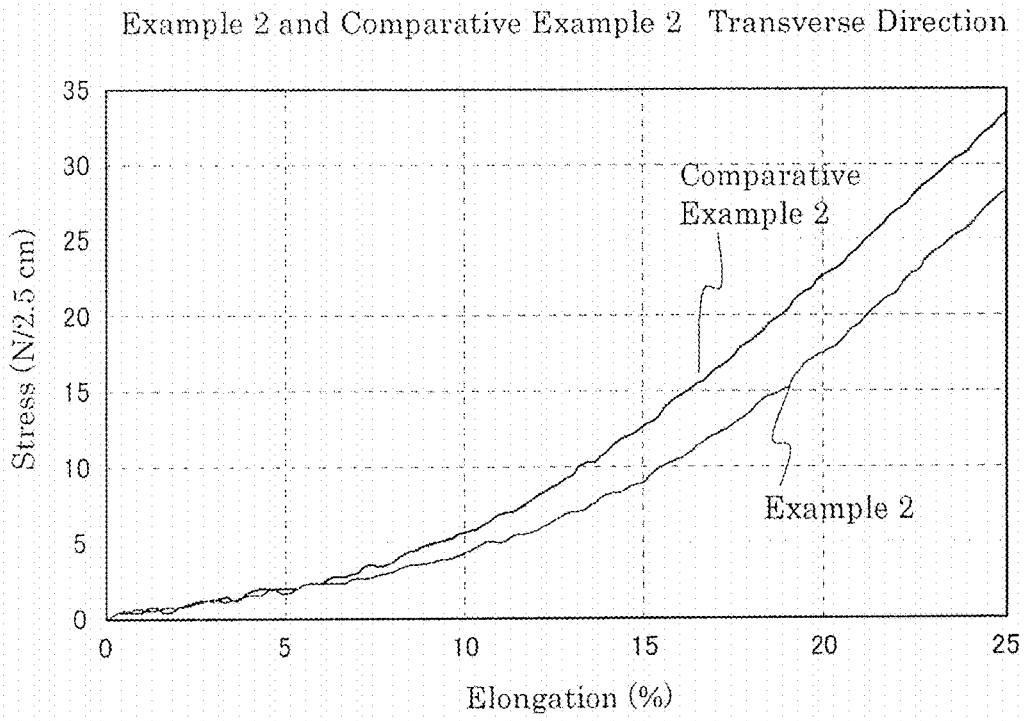
FIG. 13 is a stress-elongation curve in the transverse direction of each artificial leather of Example 2 and Comparative Example 2, which is determined according to JIS L 1096 (1999) 8.14.1 A.

The evaluation results of the obtained elastically stretchable artificial leather are shown in Table 1, and the stress-elongation curves are shown in FIGS. 12 and 13.

Example 3

A web was produced by carding and crosslapping by using sea-island composite staple fibers composed of nylon 6 as the island component and polyethylene as the sea-island (island component:sea component=50:50 (by mass); fineness: 3.5 dtex; fiber length: 51 mm; number of crimps: 12 crimp/inch).

The web was entangled by needle punching at 400 punch/cm$^2$ to obtain an entangled nonwoven fabric with a mass per unit area of 370 g/m$^2$.

After impregnating a 22% DMF solution of a polyether-based polyurethane, the entangled nonwoven fabric was immersed in a bath of a mixed solution of DMF and water to wet-coagulate the polyurethane. After removing the remaining DMF by washing with water, the sea component polyethylene was removed by extraction in a toluene bath at 85° C. The remaining toluene was azeotropically removed in a hot water bath at 100° C. and the entangled nonwoven fabric thus treated was dried, to obtain a substrate for artificial leather having a mass per unit area of 295 g/m$^2$ and thickness of 0.8 mm.

The back surface of the obtained substrate for artificial leather was buffed twice by 180-grit sandpaper to adjust the thickness to 0.7 mm while making the back surface flat and smooth. Next, the top surface was then buffed twice by 240-grit sandpaper and twice by 400-grit sandpaper successively, to obtain a raised artificial leather having a raised nap surface of nylon 6 microfine fibers.

After dyeing with a metal complex dye by using a jet dyeing machine, drying, and brushing for ordering finish, a dyed, raised artificial leather (thickness: 0.50 mm, mass per unit area: 177 g/m$^2$, apparent density: 0.354 g/cm$^3$) was obtained.

The dyed, raised artificial leather was shrunk by 2% in the machine direction in the same manner as in Example 1 by using a shrinking apparatus.

Figure 14:
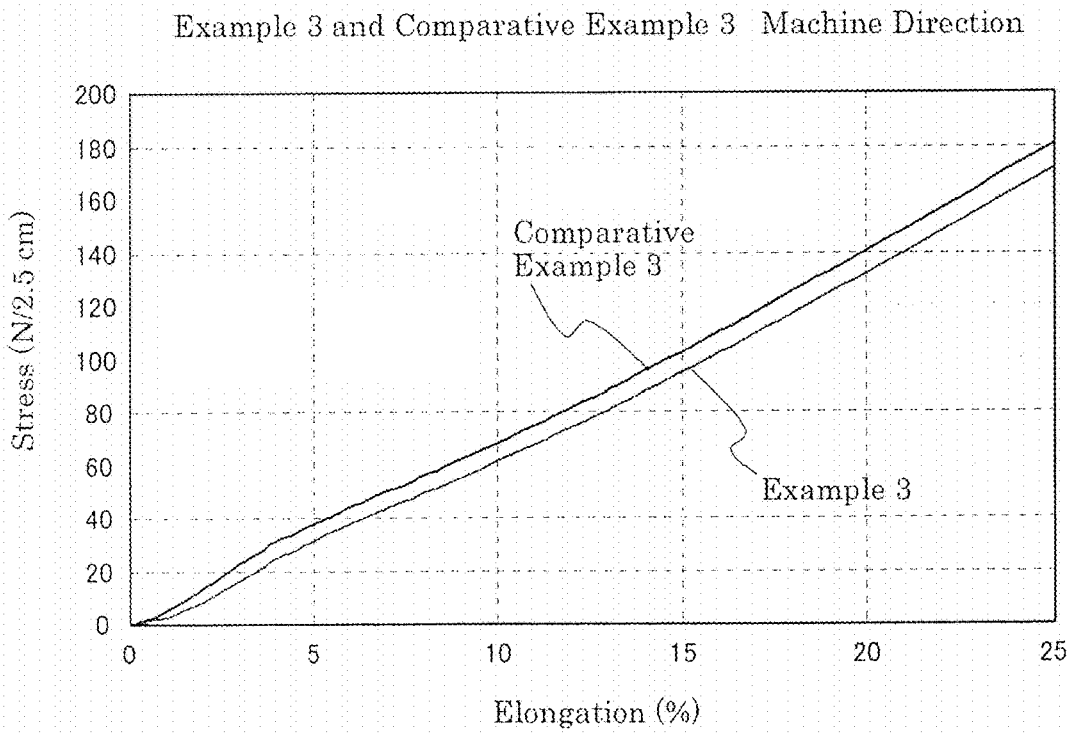
FIG. 14 is a stress-elongation curve in the machine direction of each artificial leather of Example 3 and Comparative Example 3, which is determined according to JIS L 1096 (1999) 8.14.1 A.
Figure 15:
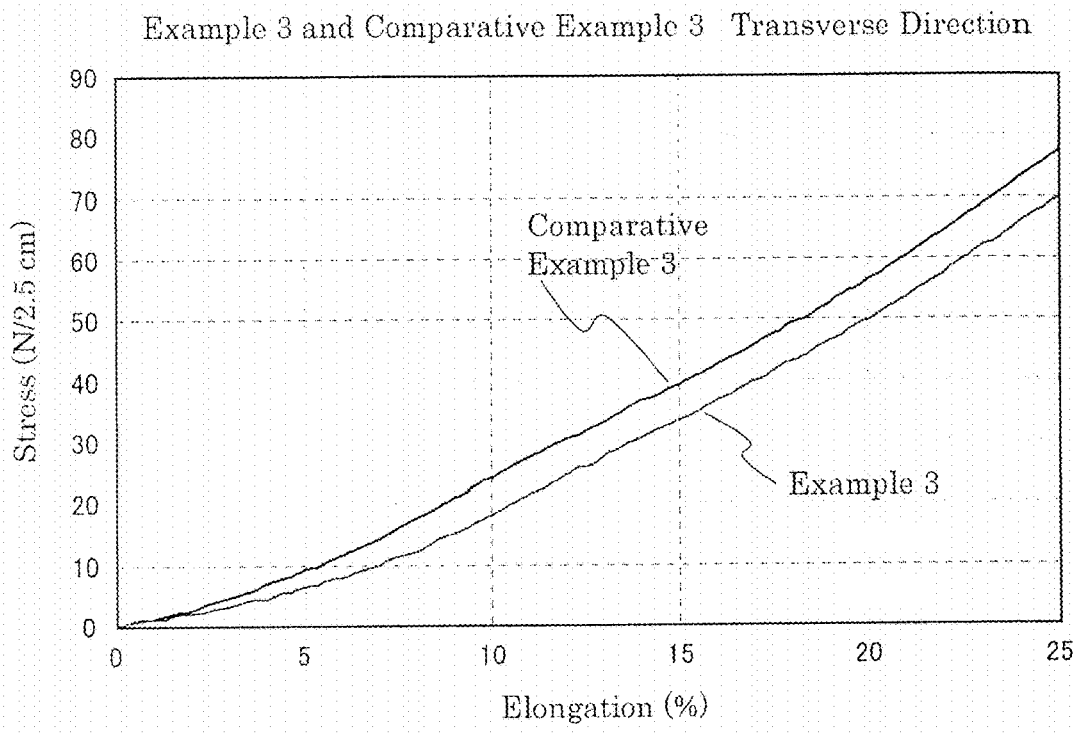
FIG. 15 is a stress-elongation curve in the transverse direction of each artificial leather of Example 3 and Comparative Example 3, which is determined according to JIS L 1096 (1999) 8.14.1 A.

The evaluation results of the obtained elastically stretchable artificial leather are shown in Table 1, and the stress-elongation curves are shown in FIGS. 14 and 15.

Example 4

PVA as the sea component polymer and a 6 mol % isophthalic acid-modified polyethylene terephthalate as the island component polymer were extruded from a spinneret for melt composite spinning (number of islands: 25/fiber) at 260° C. in a sea component/island component ratio of 25/75 (by mass). The ejector pressure was adjusted such that the spinning speed was 3700 m/min, and sea-island fibers having an average fineness of 2.1 dtex were deposited on a net, thereby obtaining a spun-bond sheet. Then, the spun-bond sheet on the net was slightly pressed by a metal roll of a surface temperature of 42° C. to prevent the surface from fluffing. Thereafter, the spun-bond sheet was peeled off from the net and then was hot-pressed between a lattice-patterned metal roll of a surface temperature of 55° C. and a back roll to obtain a filament web having a mass per unit area of 28 g/m$^2$ in which the sea-island fibers on the surface were temporarily fuse-bonded in lattice pattern.

After providing an oil agent and an antistatic agent, the filament web was cross-lapped into 8 layers to prepare a lapped web having a total mass per unit area of 218 g/m$^2$, which was then sprayed with an oil agent for preventing needle break. The lapped web was needle-punched at 3300 punch/cm$^2$ alternatively from both sides using 6-barb needles with a tip-to-first barb distance of 3.2 mm at a punching depth of 8.3 mm, thereby obtaining an entangled nonwoven fabric. The areal shrinkage by the needle punching was 68% and the mass per unit area of the obtained entangled nonwoven fabric was 311 g/m$^2$.

The entangled nonwoven fabric was allowed to shrink by immersing in a hot water at 70° C. for 28 s, and the modified PVA as the sea component polymer was removed by extraction by repeating dip-nip treatment in a hot water at 95° C., thereby obtaining a microfiberized nonwoven fabric in which fiber bundles of 25 microfine fibers each having an average fineness of 0.09 dtex were three-dimensionally entangled. The areal shrinkage by the shrinking treatment was 52%. The microfiberized nonwoven fabric has a mass per unit area of 446 g/m$^2$ and an apparent density of 0.602 g/cm$^3$.

The microfiberized nonwoven fabric was buffed to adjust the thickness to 0.9 mm. Then, the obtained microfiberized nonwoven fabric was impregnated with a dispersion containing 300 parts by mass of an aqueous acrylic emulsion (solid concentration: 60% by mass) and 90 parts by mass of pigment by a dip-nip impregnation which was repeated twice at a line speed of 6 m/min using a patter. The solid concentration of the acrylic resin in the aqueous emulsion was 180 g/L and the solid concentration of the pigment in the aqueous emulsion was 90 g/L. The impregnated aqueous emulsion was dried by spraying hot air at 120° C. on the surface to migrate the acrylic elastomer of ice gray color toward the surface and coagulate it, thereby obtaining a semi grain-finished artificial leather (thickness: 0.88 mm, mass per unit area: 437 g/m$^2$, apparent density: 0.497 g/cm$^3$).

The semi grain-finished artificial leather was shrunk by 10.6% in the machine direction in the same manner as in Example 1 by using a shrinking apparatus.

Figure 16:
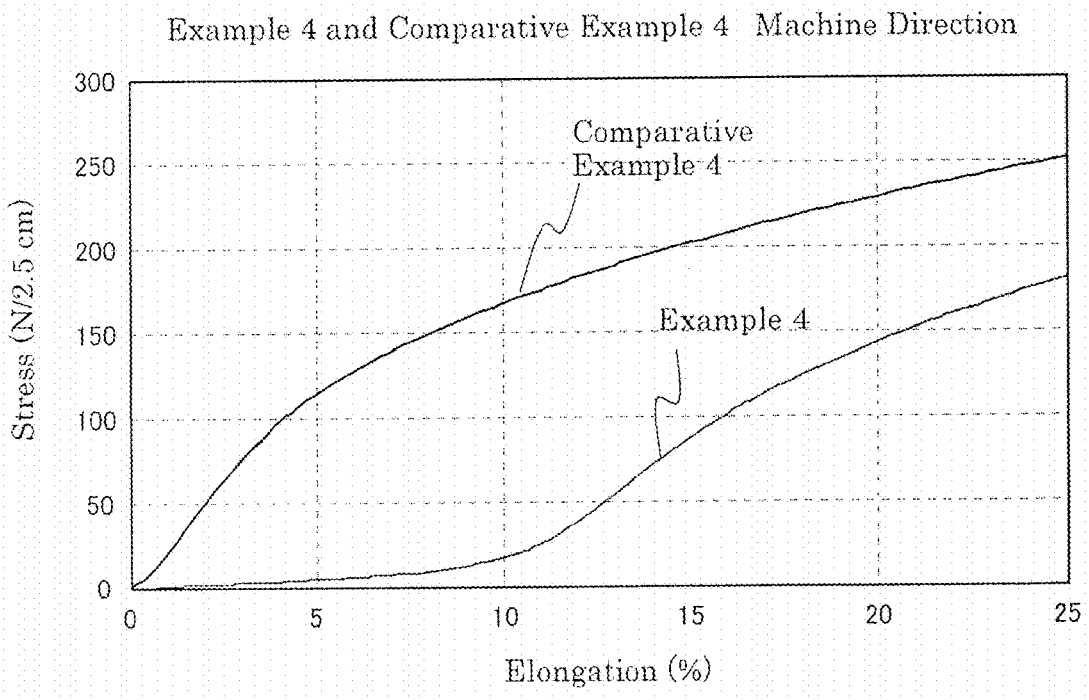
FIG. 16 is a stress-elongation curve in the machine direction of each artificial leather of Example 4 and Comparative Example 4, which is determined according to JIS L 1096 (1999) 8.14.1 A.
Figure 17:
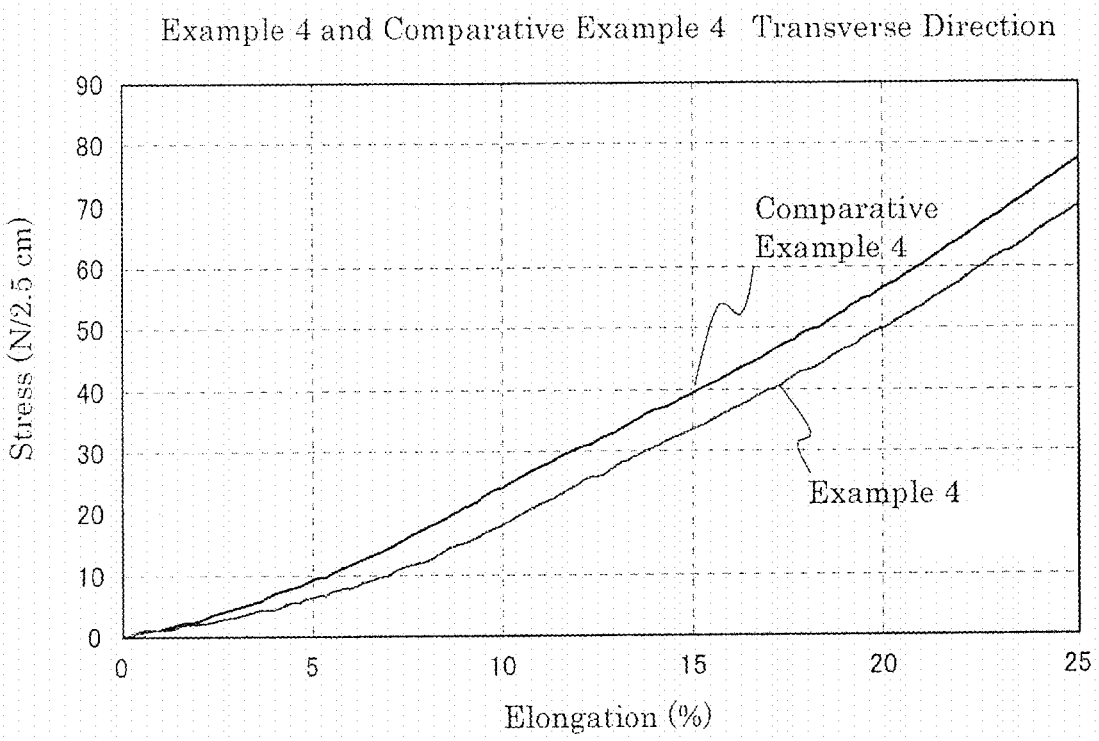
FIG. 17 is a stress-elongation curve in the transverse direction of each artificial leather of Example 4 and Comparative Example 4, which is determined according to JIS L 1096 (1999) 8.14.1 A.

The evaluation results of the obtained elastically stretchable artificial leather is shown in Table 1. The stress-elongation curves are shown in FIGS. 16 and 17.

Comparative Examples 1 to 4

Each of artificial leathers was obtained in the same manner as in Examples 1 to 4, respectively, except for omitting the shrinking process. The evaluation results are shown in Table 2. The stress-elongation curves in the machine direction and the transverse direction of the artificial leathers obtained in Comparative Examples 1 to 4 are shown in FIGS. 10 to 17. The scanning electron microphotographs of the cross sections taken in parallel to the thickness direction and the machine direction in Comparative Example 1 are shown in FIGS. 6 and 7.

TABLE 1

| | Examples | | | |
|---|---|---|---|---|
| | 1 | 2 | 3 | 4 |
| Microfine fiber | | | | |
| type | modified PET filament | modified PET filament | nylon 6 staple | modified PET filament |
| fiber length | | | | |
| fineness (dtex) | 0.09 | 0.09 | 0.006 | 0.09 |
| Elastic polymer | | | | |
| type | PU*3 | PU | PU | —*2 |
| aqueous/organic solvent-based | aqueous | solvent-based | solvent-based | — |
| content (% by weight) | 12 | 18 | 40 | — |
| Artificial leather (before shrinking process) | | | | |
| mass per unit area (g/m$^2$) | 377 | 304 | 177 | 437 |
| thickness (mm) | 0.8 | 0.65 | 0.5 | 0.88 |
| apparent density (g/cm$^3$) | 0.471 | 0.468 | 0.354 | 0.497 |
| Amount of water added (%) | 1.5 | 1.8 | 2.5 | 1.3 |
| Heat treatment | | | | |
| temperature (° C.) | 120 | 120 | 120 | 120 |
| shrinkage in MD (%) | 9.2 | 3 | 2 | 10.6 |
| Heat set temperature (° C.) | 120 | 120 | 120 | 120 |
| Artificial leather*1 | | | | |
| mass per unit area (g/m$^2$) | 413 | 326 | 189 | 516 |
| thickness (mm) | 0.75 | 0.63 | 0.44 | 0.95 |
| apparent density (g/cm$^3$) | 0.551 | 0.517 | 0.43 | 0.543 |
| elongation (%, load: 40 N/cm) | 21 | 19 | 35 | 18 |
| feel of resistance to further stretching | | | | |
| 30% elongation/5% elongation | 33.1 | 9.5 | 5.7 | 35.2 |
| rating | A | A | B | A |
| stiffness (g) | | | | |
| top surface | | | | |
| MD*4 | 41.4 | 24 | 17.1 | 156.2 |
| TD*5 | 66.4 | 13.4 | 6.8 | 98.8 |
| back surface | | | | |
| MD | 46.8 | 25.5 | 17.6 | 159.8 |
| TD | 70.7 | 15 | 7.6 | 115 |
| 5% circular modulus (N) | | | | |
| MD | 13 | 15 | — | 19 |
| elongation factor | | | | |
| 5% circular modulus (MD)/thickness | 17.3 | 23.8 | — | 20.0 |
| wave-like structure (MD) | | | | |
| pitch (per mm) | 3.2 | 2.7 | 0.0 | 3.1 |
| average height (μm) | 123 | 68 | 0.0 | 132 |
| average pitch (μm) | 315.6 | 367.6 | 0.0 | 327.9 |
| $F_{5\%}$ (N/2.5 cm) (MD) | 6.6 | 9.6 | 31.6 | 4.7 |
| $F_{5\%}'$ (N/2.5 cm) (TD) | 79.8 | 1.7 | 6.3 | 6.2 |
| $F_{10\%}$ (N/2.5 cm) (MD) | 13.3 | 54.8 | 61.5 | 17.4 |
| $F_{10\%}'$ (N/2.5 cm) (TD) | 109.2 | 4.3 | 18 | 16.8 |
| $F_{20\%}$ (N/2.5 cm) (MD) | 89.9 | 126 | 131.9 | 143.5 |
| $F_{20\%}'$ (N/2.5 cm) (TD) | 120.1 | 17.6 | 49.9 | 36.8 |
| $F_{20\%}/F_{5\%}$ | 13.6 | 13.1 | 4.17 | 30.5 |
| $S_{5\%}$ | 0.59 | 6.03 | 6.76 | 1.32 |
| $S_{20\%}$ | 6.03 | 5.73 | 7.35 | 9.41 |
| $S_{20\%}/S_{5\%}$ | 10.2 | 0.95 | 1.09 | 12.4 |
| maximum slope $S_{0-5\%max}$ | 2.79 | 6.03 | 8.82 | 1.32 |

*1artificial leather (elastically stretchable artificial leather) after shrinking process for Examples 1 to 7.
*2elastic polymer was not impregnated or not measured.
*3polyurethane
*4machine direction
*5transverse direction

TABLE 2

| | Comparative Examples | | | |
|---|---|---|---|---|
| | 1 | 2 | 3 | 4 |
| Microfine fiber | | | | |
| type | modified PET filament | modified PET filament | nylon 6 staple | modified PET filament |
| fiber length | | | | |
| fineness (dtex) | 0.09 | 0.09 | 0.006 | 0.09 |
| Elastic polymer | | | | |
| type | PU*3 | PU | PU | —*2 |
| aqueous/organic solvent-based | aqueous | solvent-based | solvent-based | — |
| content (% by weight) | 12 | 18 | 40 | — |
| Artificial leather*6 | | | | |
| mass per unit area (g/m$^2$) | 377 | 304 | 177 | 437 |
| thickness (mm) | 0.8 | 0.65 | 0.5 | 0.88 |
| apparent density (g/cm$^3$) | 0.471 | 0.468 | 0.354 | 0.497 |
| elongation (%, load: 40 N/cm) | 13 | 15 | 35 | 9 |
| feel of resistance to further stretching | | | | |
| 30% elongation/5% elongation | 2.7 | 3.8 | 4.8 | 2.2 |
| rating | C | C | C | C |
| stiffness (g) | | | | |
| top surface | | | | |
| MD*4 | 117.2 | 25.2 | 18.5 | 159.8 |
| TD*5 | 67.5 | 8.6 | 5.9 | 86 |
| back surface | | | | |
| MD | 119 | 26.8 | 21 | 159.8 |
| TD | 69.7 | 8.8 | 6.3 | 82.3 |
| 5% circular modulus (N) | | | | |
| MD | 145 | 46 | — | 294 |
| elongation factor | | | | |
| 5% circular modulus (MD)/thickness | 181.3 | 70.8 | — | 334.1 |
| wave-like structure (MD) | | | | |
| pitch (per mm) | 0.0 | 0.0 | 0.0 | 0.0 |
| average height (μm) | 0.0 | 0.0 | 0.0 | 0.0 |
| average pitch (μm) | 0.0 | 0.0 | 0.0 | 0.0 |
| $F_{5\%}$ (N/2.5 cm) (MD) | 79.8 | 35.7 | 38.1 | 115.1 |
| $F_{5\%}'$ (N/2.5 cm) (TD) | 29.8 | 2.01 | 9.26 | 19.8 |
| $F_{10\%}$ (N/2.5 cm) (MD) | 109.2 | 80.2 | 68.5 | 167.7 |
| $F_{10\%}'$ (N/2.5 cm) (TD) | 61.8 | 5.68 | 24.2 | 28.1 |
| $F_{20\%}$ (N/2.5 cm) (MD) | 146.2 | 140.4 | 140.3 | 229.6 |
| $F_{20\%}'$ (N/2.5 cm) (TD) | 89.9 | 22.69 | 56.6 | 43.1 |
| $F_{20\%}/F_{5\%}$ | 1.83 | 3.93 | 3.68 | 1.99 |
| $S_{5\%}$ | 8.82 | 10.4 | 6.32 | 14 |
| $S_{20\%}$ | 3.97 | 5.73 | 8.23 | 5.14 |
| $S_{20\%}/S_{5\%}$ | 0.45 | 0.55 | 1.3 | 0.37 |
| maximum slope $S_{0-5\%max}$ | 22.2 | 11 | 9.7 | 29.7 |

*6artificial leather not shrink-processed in Comparative Examples 1 to 7.

Example 5

A filament web was produced from sea-island composite filaments (island component:sea component=50:50 (by mass); fineness: 3.5 dtex) which was composed of nylon 6 as the island component and polyethylene as the sea component.

The web was entangled by needle punching at 400 punch/cm$^2$ to obtain an entangled nonwoven fabric having a mass per unit area of 780 g/m$^2$.

After impregnating a 22% DMF solution of a polyether-based polyurethane, the entangled nonwoven fabric was immersed in a bath of a mixed solution of DMF and water to wet-coagulate the polyurethane. After removing the remaining DMF by washing with water, the sea component polyethylene was removed by extraction in a toluene bath at 85° C. The remaining toluene was azeotropically removed in a hot water bath at 100° C. and the entangled nonwoven fabric thus treated was dried and divided into two pieces in the thickness direction, to obtain a substrate for artificial leather having a mass per unit area of 325 g/m$^2$ and a thickness of 0.77 mm.

The back surface of the obtained substrate for artificial leather was buffed twice by 180-grit sandpaper to adjust the thickness to 0.7 mm while making the back surface flat and smooth. Next, the top surface was then buffed twice by 240-grit sandpaper and twice by 400-grit sandpaper successively, to obtain a raised artificial leather having a raised nap surface of nylon 6 microfine fibers (thickness: 0.61 mm, mass per unit area: 261 g/m$^2$, apparent density: 0.428 g/cm$^3$).

The raised artificial leather was shrunk by 4.8% in the machine direction in the same manner as in Example 1 by using a shrinking apparatus.

The evaluation results of the obtained elastically stretchable artificial leather are shown in Table 3.

Example 6

PVA as the sea component polymer and a 6 mol % isophthalic acid-modified polyethylene terephthalate as the island component polymer were extruded from a spinneret for melt composite spinning (number of islands: 25/fiber) at 260° C. in a sea component/island component ratio of 25/75 (by mass). The ejector pressure was adjusted such that the spinning speed was 3700 m/min, and sea-island fibers having an average fineness of 2.1 dtex were deposited on a net, thereby obtaining a spun-bond sheet. Then, the spun-bond sheet on the net was slightly pressed by a metal roll of a surface temperature of 42° C. to prevent the surface from fluffing. Thereafter, the spun-bond sheet was peeled off from the net and then was hot-pressed between a lattice-patterned metal roll of a surface temperature of 55° C. and a back roll to obtain a filament web having a mass per unit area of 32 g/m$^2$ in which the sea-island fibers on the surface were temporarily fuse-bonded in lattice pattern.

After providing an oil agent and an antistatic agent, the filament web was cross-lapped into 12 layers to prepare a lapped web having a total mass per unit area of 370 g/m$^2$, which was then sprayed with an oil agent for preventing needle break. The lapped web was needle-punched at 3300 punch/cm$^2$ alternatively from both sides using 6-barb needles with a tip-to-first barb distance of 3.2 mm at a punching depth of 8.3 mm, thereby obtaining an entangled nonwoven fabric. The areal shrinkage by the needle punching was 70% and the mass per unit area of the obtained entangled nonwoven fabric was 528 g/m$^2$.

The entangled nonwoven fabric was allowed to shrink by immersing in a hot water at 70° C. for 28 s, and the modified PVA as the sea component polymer was removed by extraction by repeating dip-nip treatment in a hot water at 95° C., thereby obtaining a microfiberized nonwoven fabric in which fiber bundles of 25 microfine fibers each having an average fineness of 0.09 dtex were three-dimensionally entangled. The areal shrinkage by the shrinking treatment was 50%. The microfiberized nonwoven fabric has a mass per unit area of 780 g/m$^2$ and an apparent density of 0.610 g/cm$^3$.

The microfiberized nonwoven fabric was buffed to adjust the thickness to 1.25 mm. Then, the obtained microfiberized nonwoven fabric was impregnated with a dispersion containing 300 parts by mass of an aqueous acrylic emulsion (solid concentration: 60% by mass) and 90 parts by mass of pigment by a dip-nip impregnation which was repeated several times at a line speed of 4 m/min using a patter. The solid concentration of the acrylic resin in the aqueous emulsion was 180 g/L and the solid concentration of the pigment in the aqueous emulsion was 90 g/L. The impregnated aqueous emulsion was dried by spraying hot air at 120° C. on the surface to migrate the acrylic elastomer of ice gray color toward the surface and coagulate it, thereby obtaining a semi grain-finished artificial leather (thickness: 1.26 mm, mass per unit area: 744 g/m$^2$, apparent density: 0.590 g/cm$^3$).

The semi grain-finished artificial leather was shrunk by 10.6% in the machine direction in the same manner as in Example 1 by using a shrinking apparatus.

The evaluation results of the obtained elastically stretchable artificial leather are shown in Table 3.

Example 7

A web was produced by carding and crosslapping by using sea-island composite staple fibers composed of polyethylene terephthalate as the island component and polyethylene as the sea component (island component:sea component=65:35 (by mass); fineness: 4.5 dtex; fiber length: 51 mm).

The web was entangled by needle punching at 1500 punch/cm$^2$ to obtain an entangled nonwoven fabric with a mass per unit area of 890 g/m$^2$.

After impregnating a 14% DMF solution of a polyether-based polyurethane, the entangled nonwoven fabric was immersed in a bath of a mixed solution of DMF and water to wet-coagulate the polyurethane. After removing the remaining DMF by washing with water, the sea component polyethylene was removed by extraction in a toluene bath at 85° C. The remaining toluene was azeotropically removed in a hot water bath at 100° C. and the entangled nonwoven fabric thus treated was dried, to obtain a substrate for artificial leather.

The back surface of the obtained substrate for artificial leather was buffed twice by 180-grit sandpaper to adjust the thickness to 0.78 mm while making the back surface flat and smooth. The top surface was then buffed twice by 240-grit sandpaper and twice by 400-grit sandpaper successively, to form a raised nap surface of polyethylene terephthalate microfine fibers, thereby converting the substrate for artificial leather to a raised artificial leather (thickness: 0.78 mm, mass per unit area: 340 g/m$^2$, apparent density: 0.436 g/cm$^3$).

The raised artificial leather was shrunk by 5.4% in the machine direction in the same manner as in Example 1 by using a shrinking apparatus, to obtain an elastically stretchable artificial leather.

The evaluation results of the obtained elastically stretchable artificial leather are shown in Table 3.

Comparative Examples 5 to 7

Each of artificial leathers was obtained in the same manner as in Examples 5 to 7, respectively, except for omitting the shrinking process. The evaluation results are shown in Table 4.

TABLE 3

| | Examples | | |
|---|---|---|---|
| | 5 | 6 | 7 |
| Microfine fiber | | | |
| type | nylon 6 | modified PET | modified PET |
| fiber length | filament | filament | staple |
| fineness (dtex) | 0.006 | 0.09 | 0.18 |
| Elastic polymer | | | |
| type | PU | — | PU |
| aqueous/organic solvent-based | solvent-based | — | solvent-based |
| content (% by weight) | 38 | — | 18 |
| Artificial leather (before shrinking process) | | | |
| mass per unit area (g/m$^2$) | 261 | 744 | 340 |
| thickness (mm) | 0.61 | 1.26 | 0.78 |
| apparent density (g/cm$^3$) | 0.428 | 0.590 | 0.436 |
| Amount of water added (%) | 2.2 | 0.8 | 1.6 |
| Heat treatment | | | |
| temperature (° C.) | 120 | 120 | 120 |
| shrinkage in MD (%) | 4.8 | 10.6 | 5.4 |
| Heat set temperature (° C.) | 120 | 120 | 120 |
| Artificial leather*1 | | | |
| mass per unit area (g/m$^2$) | 265 | 879 | 375 |
| thickness (mm) | 0.63 | 1.39 | 0.78 |
| apparent density (g/cm$^3$) | 0.421 | 0.632 | 0.481 |
| elongation (%, load: 40 N/cm) | 14 | 16 | 16 |
| feel of resistance to further stretching | | | |
| 30% elongation/5% elongation | 5.8 | 44.9 | 17.9 |
| rating | B | A | A |
| stiffness (g) | | | |
| top surface | | | |
| MD*4 | 95.5 | — | 72.4 |
| TD*5 | 52.9 | — | 89.7 |
| back surface | | | |
| MD | 75.4 | — | 70.9 |
| TD | 40.4 | — | 89.9 |
| 5% circular modulus (N) | | | |
| MD | 66 | 23 | 26 |
| elongation factor | | | |
| 5% circular modulus (MD)/thickness | 104.8 | 16.5 | 33.3 |
| wave-like structure (MD) | | | |
| pitch (per mm) | 0.0 | 2.5 | 3.8 |
| average height (μm) | 0.0 | 91 | 72 |
| average pitch (μm) | 0.0 | 404.9 | 261.4 |

TABLE 4

| | Comparative Examples | | |
|---|---|---|---|
| | 5 | 6 | 7 |
| Microfine fiber | | | |
| type | nylon 6 | modified PET | modified PET |
| fiber length | filament | filament | staple |
| fineness (dtex) | 0.006 | 0.09 | 0.18 |
| Elastic polymer | | | |
| type | PU | — | PU |
| aqueous/organic solvent-based | solvent- | — | solvent- |

TABLE 4-continued

| | Comparative Examples | | |
|---|---|---|---|
| | 5 | 6 | 7 |
| | based | | based |
| content (% by weight) | 38 | — | 18 |
| Artificial leather*6 | | | |
| mass per unit area (g/m$^2$) | 261 | 744 | 340 |
| thickness (mm) | 0.61 | 1.26 | 0.78 |
| apparent density (g/cm$^3$) | 0.428 | 0.59 | 0.436 |
| elongation (%, load: 40 N/cm) | 12 | 7 | 13 |
| feel of resistance to further stretching | | | |
| 30% elongation/5% elongation | 4.6 | 2.3 | 4.9 |
| rating | C | C | C |
| stiffness (g) | | | |
| top surface | | | |
| MD*4 | 159.8 | — | 159.8 |
| TD*5 | 62.4 | — | 129.2 |
| back surface | | | |
| MD | 159.8 | — | 159.8 |
| TD | 58 | — | 135.4 |
| 5% circular modulus (N) | | | |
| MD | 128 | 465 | 138 |
| elongation factor | | | |
| 5% circular modulus (MD)/ thickness | 209.8 | 369.0 | 176.9 |
| wave-like structure (MD) | | | |
| pitch (per mm) | 0.0 | 0.0 | 0.0 |
| average height (μm) | 0.0 | 0.0 | 0.0 |
| average pitch (μm) | 0.0 | 0.0 | 0.0 |

The elastically stretchable artificial leathers obtained in Examples 1, 2, 4, 6, and 7 had a micro wave-like structure extending along the machine direction and a good elongation factor. With these properties, the stretchability at small elongation and the feel of resistance to further stretching were made good. In addition, the elastically stretchable artificial leathers were soft and flexible, had touch with dense feel, and formed small uniform wrinkles by bending. Therefore, the elastically stretchable artificial leathers are extremely excellent as the materials for car seats and sport shoes.

In addition, the elastically stretchable artificial leather obtained in Examples 1, 2, 4, 6, and 7 showed a smaller stress at 5% elongation, while showing a relatively larger stress at 20% elongation. With these properties, the elastically stretchable artificial leather showed a good formability suitable for the use of interior goods, seats, and shoes and had the shape stability of formed products was excellent. In addition, the elastically stretchable artificial leather kept the round feel of raw material when bending and combinedly had a touch with dense feel.

Although the artificial leathers of Example 3 and 5 were produced through the mechanical shrinking process and the heat setting process, the wave-like structure was not formed. Therefore, the stretchability at small elongation or the feel of resistance to further stretching was slightly poor and the touch was slightly hard. However, since the artificial leathers were mechanically shrunk and heat-set, the artificial leathers combined a good stretchability in the machine direction and a soft touch, was flexible while having a high density and excellent in the mechanical properties, and formed small uniform wrinkles by bending. Therefore, the artificial leathers are applicable to the materials for clothing and sport shoes.

As seen from Tables 2 and 4, the artificial leathers of comparative examples were poor in the stretchability and the feel of resistance to further stretching in the machine direction and had a hard touch, as compared with the elastically stretchable artificial leathers of Examples 1 to 7.

INDUSTRIAL APPLICABILITY

According to the present invention, an elastically stretchable artificial leather having a moderate stretchability and a feel of resistance to further stretching in the machine direction is obtained. With its good wearing comfort and excellent processability, the elastically stretchable artificial leather is suitable for use in the production of clothing, furniture, car seats, shoes, sport shoes, and other leather products.

REFERENCE NUMERALS

1: Artificial leather
2: Drum
3: Belt
4: Pressure roller
5*a*, 5*b*: Turn roller
6: Shrunk artificial leather
11: Metal roller
12: Thick rubber portion
13: Rubber roller
14: Shrunk artificial leather

What is claimed is:

1. A method of producing an elastically stretchable artificial leather comprising:

forming microfiberizable fibers into a web;

entangling the obtained web to produce an entangled nonwoven fabric;

converting the microfiberizable fibers in the nonwoven fabric to microfine fibers, thereby producing a substrate for artificial leather;

producing an artificial leather from the obtained substrate for artificial leather;

bringing the obtained artificial leather into close contact with an elastomer sheet stretched in a machine direction by 5 to 40%, shrinking the artificial leather in the machine direction simultaneously with the elastomer sheet by relaxing elongation of the elastomer sheet to obtain an artificial leather in shrunk state, heat treating the artificial leather in shrunk state; and peeling the heat treated artificial leather off from the elastomer sheet thereby producing the elastically stretchable artificial leather.

2. The method according to claim 1, wherein the method further comprises impregnating an elastic polymer into the entangled nonwoven fabric or the substrate for artificial leather and then coagulating the impregnated elastic polymer.

3. The method according to claim 1, wherein the elastomer sheet is a natural rubber sheet or a synthetic rubber sheet.

4. The method according to claim 1, wherein the elastomer sheet is stretched in the machine direction by utilizing a difference between inner and outer circumferences of the curved elastomer sheet that is run in contact with a surface of a cylinder, or by utilizing an elongation when compressing the elastomer sheet; and the elastomer sheet is shrunk in the machine direction by relaxing the stretched state, thereby allowing the artificial leather to shrink in the machine direction.

5. The method according to claim 1, wherein the elastomer sheet has a thickness of 40 to 75 mm.

6. The method according to claim 4, wherein the elastomer sheet runs along a cylinder while holding the artificial leather therebetween, thereby allowing a surface in contact with the artificial leather to shrink in the machine direction.

7. The method according to claim 6, wherein an apparent coefficient of dynamic friction between the elastomer sheet and the artificial leather is from 0.8 to 1.7 and a coefficient of dynamic friction between the cylinder and the artificial leather is 0.5 or less.

8. The method according to claim 6, wherein the cylinder is a heated cylinder.

9. The method according to claim 1, wherein the artificial leather is subjected to a pre-heating treatment, a humidifying treatment, or both before contacting the elastomer sheet.

10. The method according to claim 2, wherein the elastic polymer is a coagulated product of an aqueous emulsion of polyurethane.

11. The method according to claim 1, wherein the microfine fiber is a non-elastic fiber.

12. The method according to claim 1, further comprising cooling the artificial leather immediately after peeling off from the elastomer sheet to 85° C. or lower or conveying the artificial leather by a belt.

* * * * *